US005960243A

United States Patent [19]

Daigo et al.

[11] Patent Number: 5,960,243

[45] Date of Patent: Sep. 28, 1999

[54] FIXATION APPARATUS AND IMAGE FORMING APPARATUS

[75] Inventors: Hiroshi Daigo; Yoshio Kanasawa, both of Kanagawa, Japan

[73] Assignee: Fuji Xerox Co., Ltd., Tokyo, Japan

[21] Appl. No.: 08/888,003

[22] Filed: Jul. 3, 1997

[30] Foreign Application Priority Data

Jul. 3, 1996 [JP] Japan ..... 8-192938
Jul. 4, 1996 [JP] Japan ..... 8-193861

[51] Int. Cl.[6] ..... G03G 15/20

[52] U.S. Cl. ..... 399/329

[58] Field of Search ..... 399/320, 328, 399/329, 330, 335, 338; 219/216

[56] References Cited

U.S. PATENT DOCUMENTS

| | | | |
|---|---|---|---|
| 5,119,143 | 6/1992 | Shimura | 399/329 |
| 5,148,226 | 9/1992 | Setoriyama et al. | 399/329 |
| 5,235,395 | 8/1993 | Ishiwata | 399/329 |
| 5,257,078 | 10/1993 | Kuroda | 399/329 |
| 5,621,512 | 4/1997 | Uehara et al. | 399/328 |
| 5,666,624 | 9/1997 | Kanesawa et al. | 399/329 |

FOREIGN PATENT DOCUMENTS

| | | |
|---|---|---|
| 4-44075 | 2/1992 | Japan . |
| 5-150679 | 6/1993 | Japan . |
| 8-262903 | 10/1996 | Japan . |

*Primary Examiner*—Sandra Brase
*Attorney, Agent, or Firm*—Oliff & Berridge, PLC

[57] ABSTRACT

An apparatus is provided to easily prevent walking of a belt while avoiding twisting, warping and buckling of the belt including using an inexpensive endless belt with low rigidity in a fixation apparatus of so-called belt nip method. The apparatus includes a heating roll, an endless belt that presses against the heating roll and rotates along with the heating roll, and a pressing member that presses the endless belt against the heating roll 1 and forms a contact nip region between the endless belt and the heating roll. A belt walk guide that limits walking of the edge of the endless belt is provided on at least one side of the contact nip region between the between the heating roll and the endless belt. The belt walk guide is positioned on an axis parallel to an axis of the heating roll and passing through the contact nip region. The apparatus also includes a pressure roll and the endless belt.

17 Claims, 19 Drawing Sheets

FIXATION APPARATUS AND IMAGE FORMING APPARATUS

BACKGROUND OF THE INVENTION

1. Field of Invention

The invention relates to a fixation apparatus that fixes using heat and pressure an unfixed toner image onto, for example, a recording sheet in an image forming apparatus using an electronic photography method, such as a copy machine, a printer or a facsimile. More particularly, the invention relates to an improvement of a fixation apparatus of a belt nip method with an endless belt arranged in contact with a fixing roll used in applying heat or pressure.

2. Description of Related Art

Applicant has proposed a fixation apparatus employing what is known in the art as the belt nip method, for example, in Japanese Patent Application No. 7-65629.

Such a fixation apparatus includes, for example, a heating roll having a heat source and being capable of rotation and an endless belt which is pressed onto said heating roll. The endless belt moves in conjunction with the heating roll. A pressing member arranged on the inside of the endless belt presses the endless belt against the heating roll, thereby forming a contact nip between the endless belt and the heating roll. The arrangement is such that an unfixed toner is fixed by heat and pressure onto a recording sheet by the recording sheet being passed through the contact nip region.

In this kind of fixation apparatus which uses a belt nip method, it is possible to secure a wide contact nip region with relatively low load in comparison, for example, with the roll pair method (a method with a heating roll and a pressure roll arranged in contact). By reducing the load, the core of the heating roll does not require the bending strength needed in the conventional model, and consequently can be made thinner than in the conventional model. Hence, it is possible to shorten the time required to raise the temperature of the heating roll from room temperature to a temperature where the fixation action is possible. In addition, because the pressing member is anchored in a non-rotating state, it is possible to reduce the heat absorption from the heating roll.

Further, concerning the endless belt, there are no, for example, suspension rolls. If the arrangement is such that there is substantially no contact outside the contact nip region, there is no excess radiation of heat, and heat absorption from the heating roll is reduced.

Through these measures, it is possible to reduce the time required to take the fixation apparatus from a waiting state to a state where the fixation action is possible, hereafter called the warmup time. By making this warmup time on the order of 15–30 seconds, it is possible to start heating of the fixation apparatus from room temperature from the time of reception of a signal to start image formation, thereby enabling image formation without a wait. That is, the fixation apparatus of the belt nip method conforms to so-called instant start.

However, in the above-described fixation apparatus which uses a belt nip method, technical problems arise. The endless belt tends to walk in one of the belt shaft directions because of differences in perimeter length on the two edges of the belt and differences in the load on the two edges of the contact nip region, or the degree of non-parallelness with the heating roll during belt installation.

The conventional method of avoiding this belt walk phenomenon (known in the art as belt walking) uses a mechanism for controlling the walking of the belt by displacing at least one of the suspension rolls, as in the fixation apparatus disclosed in Japanese Laid-Open Patent Publication No. 5-150679. However, this method requires an endless belt walk detection mechanism and the above-described roll displacement mechanism and the like, and hence is expensive.

In addition, from the perspective of reducing the radiation of heat from the endless belt, employing the above-described walk prevention mechanism is difficult when tension in the circumferential direction does not work on the endless belt.

Thus, a method of preventing walking by placing the belt edge in a guide member, for example, has been considered. This type of method which restricts the edge position of the endless belt except the contact nip region using a guide member is already known (for example, see Japanese Laid-Open Patent Publication No. 4-44075).

When this method is utilized, the belt receives a walking force from the contact nip region with the pressure roll, and movement occurs along the shaft direction. On the other hand, the edges of the belt receive a walk limiting force from the guide member when the belt collides with the guide member. At this time, the walking force and the walk limiting force are parallel. However, because these forces are not collinear, a moment acts on the belt. Technical problem arises that warping, twisting and buckling occur in the belt because of this moment. Further, with this kind of moment, a high rigidity is required in the belt so that warping, twisting and buckling do not occur in the belt.

Highly rigid belt materials, metal, and in particular, SUS and iron, can be found, but it is difficult to produce an endless belt having no seams. There are also belts which have been made seamless using welding, but the reliability of the weld spot is insufficient. In addition, electrocast belts made of nickel can be formed seamlessly, but these belts are not desirable from the standpoint of safety.

Alternatively, the strength is low in resin belts such as those made of polyimide and polytetrafluoroethylene. Consequently warping, twisting and buckling occur as described above. In order to compensate for this, it is possible to use a thick belt, but this is undesirable because of increased costs.

SUMMARY OF THE INVENTION

In consideration of the foregoing technical problems, it is an object of the invention to provide a fixation apparatus that uses the belt nip method; a fixation apparatus that uses a low rigidity, low cost endless belt; and that can easily attain prevention of belt walking while avoiding twisting, warping and buckling of the belt.

BRIEF DESCRIPTION OF THE DRAWINGS

These and other aspects and advantages of the invention will become apparent from the following detailed description of preferred embodiments when taken in conjunction with the accompanying drawings, in which.

DETAILED DESCRIPTION OF PREFERRED EMBODIMENTS

Figure 1A:
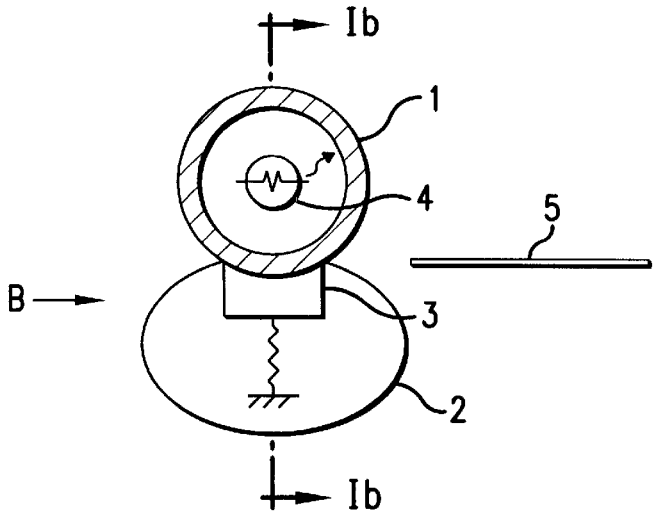
FIG. 1*a* shows the basic arrangement of a fixation apparatus corresponding to a preferred embodiment of the invention.

While the invention will hereinafter be described in connection with preferred embodiments thereof, it will be understood that it is not intended to limit the invention to those embodiments. On the contrary, it is intended to cover all alternatives, modifications and equivalents that may be included within the spirit and scope of the invention as defined by the appended claims.

For a general understanding of the features of the invention, reference is made to the drawings. In the drawings, like reference numerals have been used throughout to designate like elements.

The invention is an apparatus, as shown in FIG. 1, comprising a heating roll 1 having a heat source 4. The heating roll is capable of rotating. An endless belt 2 is pressed onto the heating roll 1. A pressing member 3 is arranged on the inside of the endless belt 2 and moves in conjunction with the heating roll 1. The pressing member 3 presses the endless belt 2 against the heating roll 1, thereby forming a contact nip between the endless belt 2 and the heating roll 1. By passing a recording sheet 5 through the contact nip region an unfixed toner image is heat and pressure fixed to a recording sheet 5. The fixation apparatus further comprises a belt walk guide 6 such that walking of the edge of the endless belt 2 is restricted on at least one side of the heating roll 1. The contact nip region extends between the heating roll 1 and the endless belt 2 along a line parallel to central longitudinal axis of the heating roll.

A belt walk guide 6 may be provided on both edges of the endless belt 2; however the invention is not limited to such structure, that is, a belt walk guide 6 on either edge of the endless belt 2. In providing the belt walk guide 6 on either edge of the endless belt 2, it is necessary to always make the walking direction of the endless belt 2 be the direction toward the belt walk guide 6. This is accomplished by varying the outer diameters of the two edges of the heating roll 1, or by varying the outer diameters of the two edges of the endless belt 2, or by arranging the heating roll 1 and the endless belt 2 skewed or inclined.

In addition, the endless belt 2 may be made of material such as, for example, resin or metal. When installing such an endless belt 2, there is no interference from, for example, suspension rolls. However, it is preferable to eliminate, to the extent possible, the contact that the members make outside of the contact nip region so as to keep the radiation of heat from the endless belt 2 to a minimum.

Further, in the driving method for the fixation apparatus of the invention, there is no problem with driving either the heating roll 1 or the endless belt 2. However, in the configuration in which the endless belt 2 is not suspended, it is preferable to have rotational driving of the heating roll 1, and to have the endless belt 2 rotate in concert therewith.

In addition, the pressing member 3, which presses the endless belt 2 against the heating roll 1 and forms a contact nip region between the endless belt 2 and the heating roll 1, may include an elastically energized rigid body pressing member using an elastic energizing element such as, for example, a spring member. Alternatively, the member may include an elastic body for all or a portion of the pressing member and utilize the elastic force accompanying elastic deformation of such an elastic body. Further, a member which combines both of these arrangements may be appropriately selected.

For increased certainty of preventing buckling of the edge of the endless belt 2, it is preferable to arrange the pressing member 3 to provide curvature to the endless belt 2 at the contact nip region in the direction opposite to the cylindrical shape of the belt. Alternatively, the pressing force of the pressing member 3 may be set to be larger at the edge than the pressing force at the center of the contact nip region.

To prevent buckling of the edges of the endless belt 2, it is preferable to provide a spacer member 8. The spacer member 8 covers the space into which the edge of the endless belt 2 falls on the side adjacent the heating roll 1 on the outside of the contact nip region of the heating roll 1. So as to reduce the number of components, it is preferable to provide the spacer member 8 integrally with the belt walk guide 6 as a ring-shaped member provided on the heating roll 1 side thereof.

If the arrangement is such that the belt walk guide 6 is provided on a line parallel to the central longitudinal axis of the heating roll in the contact nip region between the heating roll 1 and the endless belt 2, the belt walk guide 6 may be provided in a fixed manner to an anchored member such as, for example, a frame. However, for example, under conditions such that a unit having roughly the same diameter as the roll diameter is used as the bearing support unit of the heating roll 1, it is preferable for the belt walk guide to include a ring-shaped member provided on the outside of the contact nip region between the heating roll 1 and the endless belt 2. Such an arrangement prevents interference with the heating roll 1. The guide may be formed integrally with the heat-insulating bushing of the bearing member, for example, so as to reduce the number of components.

Figure 1B:
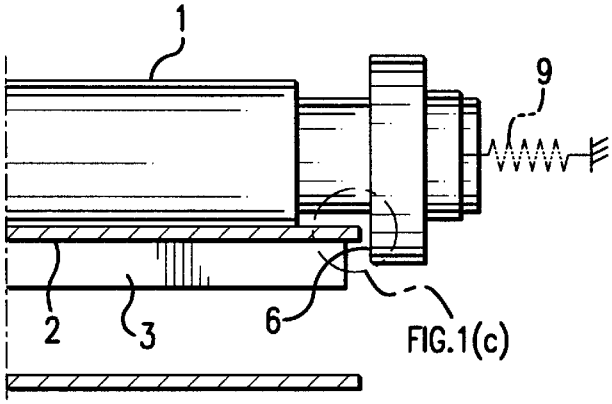
FIG. 1*b* is a partial cross-sectional view taken along line I*b*—I*b* in FIG. 1*a;*

To reduce the walking force acting on the belt walk guide 6, it is preferable to make the belt walk guide 6 movable along a direction parallel to the central longitudinal axis of the heating roll 1, and also to elastically energize the belt walk guide 6 in the direction of the endless belt 2 using the elastic energizing member 9 (indicated by the dotted line in FIG. 1*b*).

Figure 1C:
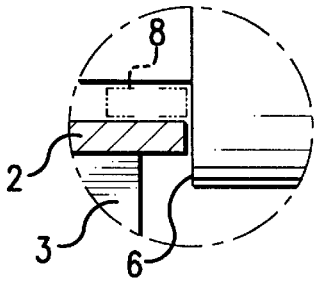
FIG. 1*c* shows the basic structure of a fixation apparatus according to another preferred embodiment of the invention.
Figure 1D:
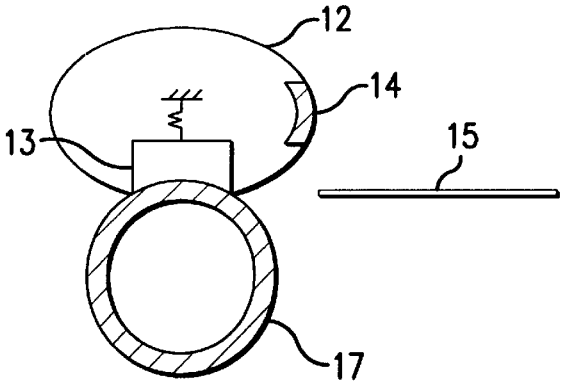

In addition, the invention is not limited to combinations of the heating roll 1 and the endless belt 2, but may also include combinations of the pressure roll 7 and the endless belt 2. Illustratively, as shown in FIG. 1(*c*), the fixation apparatus may include a pressure roll 17 capable of rotating and an endless belt 12 heated by a heat source 14. The heat source 14 rotates along with the pressure roll 17 by being pressed against the pressure roll 17. A pressing member 13 arranged on the inside of the endless belt 12 causes the endless belt 12 to be pressed against the pressure roll 17 and forms a contact nip region between the endless belt 12 and the pressure roll 17, as shown in FIG. 1*c*. An unfixed toner image is fixed by heat and pressure to a recording sheet 15 by the recording sheet 15 being passed through the contact nip region. The fixation apparatus includes a belt walk guide (not shown), corresponding to that shown in FIG. 1*b*, such that the walking of the edge of the endless belt 2 is restricted on at least one side of the pressure roll (not shown) along a direction parallel to the central longitudinal axis of the heating roll. In the fixation apparatus with this structure, each process executed with respect to the fixation apparatus shown in FIG. 1*a* and FIG. 1*b* also applies.

As shown in FIG. 1*a*, FIG. 1*b*, and similarly in FIG. 1*c*, the endless belt 2 makes contact with the belt walk guide 6. The heating roll 1 (or the pressure roll 7) and the pressing member 3 are pressed together so that the walk position thereof is restricted. With this arrangement, the walking force of the endless belt 2 and the walk limiting force from the belt walk guide 6 are collinear. Consequently, the walking force and the walk limiting force mutually cancel each other out, so that no moment acts on the belt. Accordingly, twisting and warping of the endless belt 2 does not occur.

Further, walking of the endless belt 2 is limited by the edges of the belt colliding with the belt walk guide 6 on the extension line of the contact nip region interposed between the heating roll 1 (or the pressure roll 7) and the pressing member 3. Consequently, the rigidity of the endless belt 2 is increased by this interposition pressure, so that it is more difficult for buckling to occur.

Figure 2:
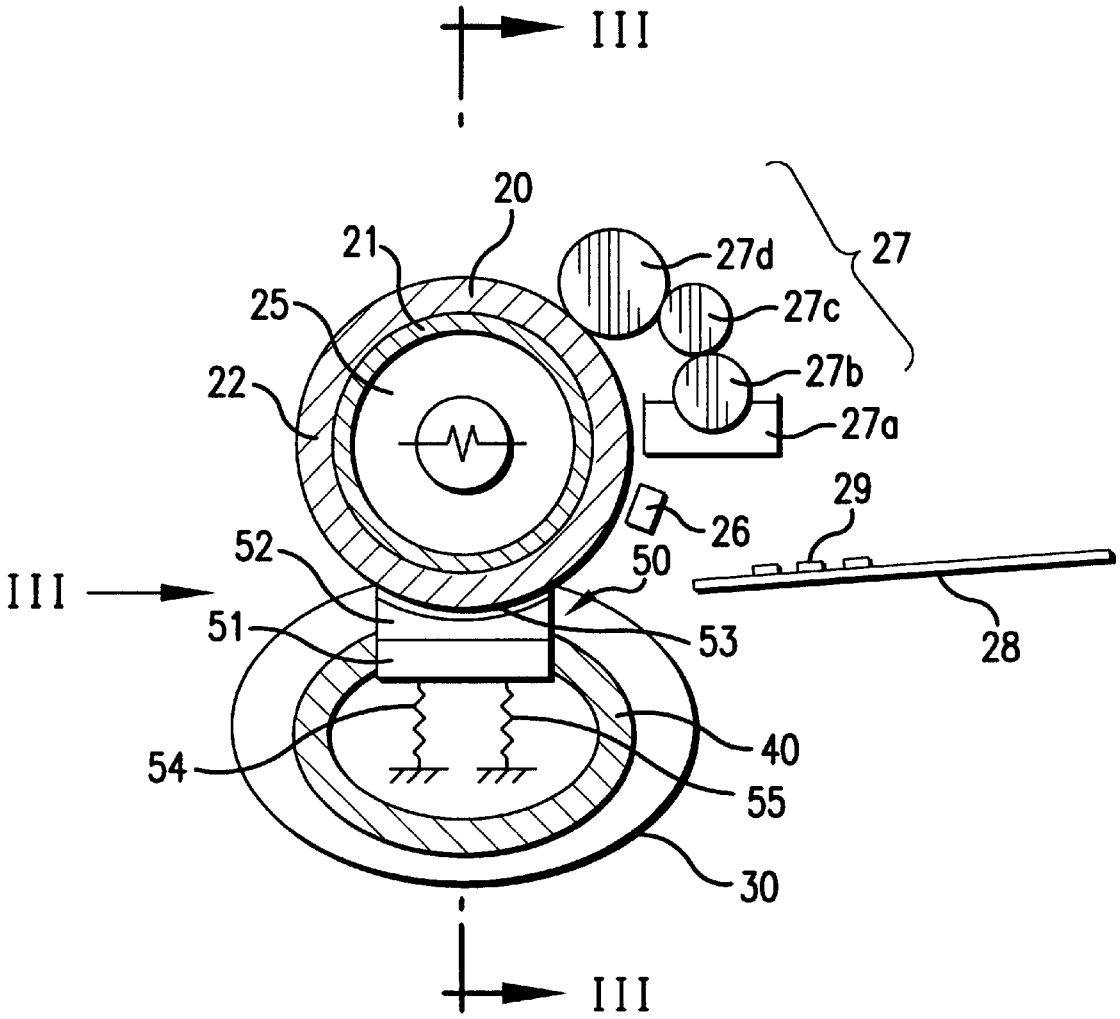
FIG. 2 is a cross-sectional view of a fixation apparatus according to another preferred embodiment of the invention.
Figure 3:
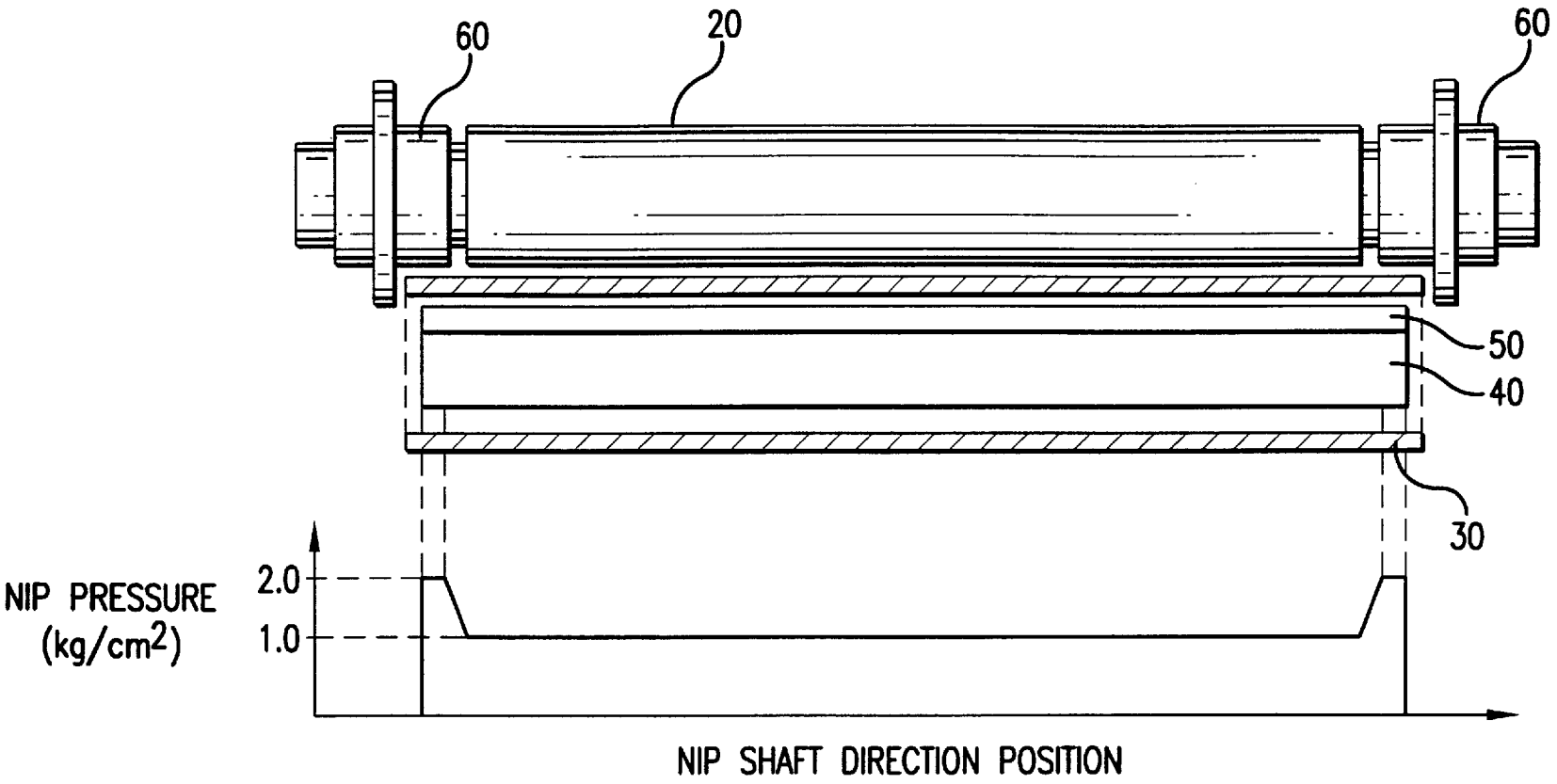
FIG. 3 is a partial cross-sectional view taken along line III—III in FIG. 2.

FIG. 2 is a cross-sectional side view of the fixation apparatus according to another embodiment of the invention. FIG. 3 is a partial cross-sectional view along direction III—III in FIG. 2. In these figures, the fixation apparatus includes a heating roll 20 that is rotationally driven, an endless belt 30 that makes contact with the heating roll 20 and rotates in concert with the heating roll 20, and a pressing member 50 that is arranged on the inside of the endless belt 30. The pressing member 50 presses the endless belt 30 against the heating roll 20, and forms a contact nip region between the endless belt 30 and the heating roll 20.

The core 21 of the heating roll 20 is preferably an aluminum cylinder with a preferred outer diameter of approximately 34 mm, a preferred inner diameter of approximately 32 mm and a preferred length of approximately 350 mm. The surface of the core 21 is preferably HTV silicone rubber of a preferable hardness of approximately 45° (JIS-A) which is preferably directly coated with a preferred thickness of approximately 1 mm as a foundation layer. On the top of this layer a layer of, for example, RTV silicon rubber is dip coated to a preferred thickness of approximately 50 mm as a top coat layer. Through such coating, a covering layer 22 is formed, and this covering layer 22 is finished to a nearly mirror-like surface. In this embodiment, the hardness of the rubber of the foundation layer is the result of measuring the hardness by applying a load of 1,000 gf in conformity with JIS K6301 using a spring type A-type hardness gauge made by Teclock. For the core 21, it is possible to use a metal component with high thermal conductivity other than aluminum. For the covering layer 22, it is possible to use another material if this material is an elastic body with high heat resistance.

Inside the core 21, a halogen lamp 25 with preferably an 850 W output is arranged as a heat source. In addition, a temperature sensor 26 is arranged on the surface of the heating roll 20, and the temperature of this surface is measured. Further, the halogen lamp 25 is feedback controlled by a temperature controller (not shown) through measurement signals from the temperature sensor 26, so that the surface of the heating roll 20 is adjusted to approximately 150° C., for example.

In addition, an oil supply apparatus 27 is provided near the heating roll 20. The oil supply apparatus 27 constantly supplies a fixed quantity of a surface lubricant to the surface of the heating roll 20 from a tank 27*a* that stores the surface lubricant through a sponge-shaped suction member 27*b* and rolls 27*c* and 27*d*. Through this arrangement, when an unfixed toner image 29 is fixed to a recording sheet 28, the offsetting of a portion of the toner by the heating roll 20 is prevented. The surface lubricant supplied by the oil supply apparatus 27 may be preferably dimethyl silicone oil (trade name "KF-96") which is made by Shinetsu Chemical Co. with a viscosity of 1000 cs.

The endless belt 30 is formed from a polyimide film with a preferred thickness of approximately 75 μm, a preferred width of approximately 300 mm and a preferred perimeter length of approximately 125 mm. On the outer perimeter surface of the endless belt 30, a lubricating layer of preferably PTFE (polytetrafluoroethylene) is formed. This endless belt 30 is wrapped around the circumference of a belt running guide 40 without tension. The belt running guide 40 is preferably made of a heat-resistant resin. Rib-shaped protrusions are provided in the direction of the circumference on the outer perimeter surface of the belt running guide, so that the surface area of contact between the inner perimeter surface of the endless belt 30 and the belt running guide 40 is reduced. The material of the belt running guide 40 has a certain degree of rigidity, and various materials can be used if the heat conducted from the endless belt 30 is not excessive and the running of the endless belt 30 is not hindered.

The pressing member 50 is made of an elastic layer 52 and a low-friction layer 53, both layered on top of a base plate 51. The base plate 51 is made of stainless steel and has a preferred width in the running direction of the belt of approximately 15 mm, a preferred length in the direction perpendicular to the plane of the paper of approximately 320 mm and a preferred thickness of approximately 5 mm. The elastic layer 52 has a preferred thickness of approximately 5 mm and is preferably composed of silicon rubber with a preferred hardness of approximately 23° (JIS-A). The rubber thickness of a non-paper passing region on both edges of the contact nip region is approximately 6 mm, and the pressing force is larger than at the nip center, as shown in FIG. 3. In this embodiment, the pressing force of the contact nip center, the paper passing region is approximately 1.0 kg/cm$^2$, and the pressing force of the nip edge, the non-paper passing region is approximately 2.0 kg/cm$^2$. Furthermore, the low friction layer 53 used is a glass fiber sheet impregnated with polytetrafluoroethylene was "FGF-400-4" (trade name) produced by Chuko Kasei.

The pressing member 50 is provided inside the endless belt 30, and is pressed toward the center of the heating roll 20 with a preferred fixed load of approximately 30 kgf using compression coil springs 54 and 55. The preferred width of the contact nip region thus formed between the heating roll 20 and the endless belt 30 is approximately 12 mm.

Further, the elastic layer 52 of the pressing member 50 is softer than the foundation layer of the heating roll 20, and consequently is more easily deformed. Hence, the endless belt 30 deforms in the direction opposite the cylindrical shape of the belt at the contact nip region. Accordingly, the cross-sectional second-order moment of the belt is large and the buckling strength is large. Furthermore, the surface of the low friction layer 53 is preferably coated with a dimethyl silicone oil (trade name "KF-96") which is produced by Shinetsu Chemical Co. with 1000 cs viscosity. Through this coating, the friction coefficient between the endless belt 30 and the pressing member 50 is further reduced.

In particular, in this embodiment, a belt walk guide 60 is provided which includes a ring-shaped walk guide unit 61 preferably made of polyamide and having a preferred outer diameter of approximately 43 mm, a bushing unit 62 having a preferred outer diameter of approximately 40 mm inserted inside bearings at an outside position in the shaft direction of the walk guide unit 61 and a collar unit 63 having a preferred outer diameter of approximately 37 mm positioned at an inside position in the shaft direction of the walk guide unit 61. These components are integrally formed, and are inserted on both external sides of the covering layer 22 of the heating roll 20.

Furthermore, in this embodiment, the belt walk guide 60 is capable of moving in the shaft direction with respect to the heating roll 20, and is pressed in the direction of the endless belt 30 by the energizing spring 65. Bushing unit 62 is inserted into bearing member (not shown).

In FIG. 2, the heating roll 20 is caused to rotate at a circumferential speed V=160 mm/s by a motor (not shown). Because of this rotation, the endless belt 30 is also caused to rotate in concert with the heating roll 20 at a speed of 160 mm/s. The toner image 29 is imprinted onto the recording sheet 28 by an imprinting apparatus (not shown), and this recording sheet 28 is conveyed toward the contact nip region from the right side of the drawing. Further, the toner image 29 is fixed onto the recording sheet 28 by pressure that acts in the contact nip region and heat given off by the halogen lamp 25 via the heating roll 20.

The endless belt 30 is caused to walk in one direction along the belt shaft by either the difference in circumference lengths between the two belt edges and the load difference between the two nip edges, or the lack of parallelness between the heating and fixation roll and the belt at the time of installation. Further, the walking of the endless belt 30 is limited by the edge of the endless belt 30 colliding with the walk guide surface 64 of the belt walk guide 60. With this arrangement, the walking force 91 of the endless belt 30 and the walk limiting force 92 from the belt walk guide 60 are collinear. Consequently, the walking force 91 and the walk limiting force 92 cancel each other out, so that no moment acts on the belt. Accordingly, twisting and warping do not occur in the belt.

Figure 6:
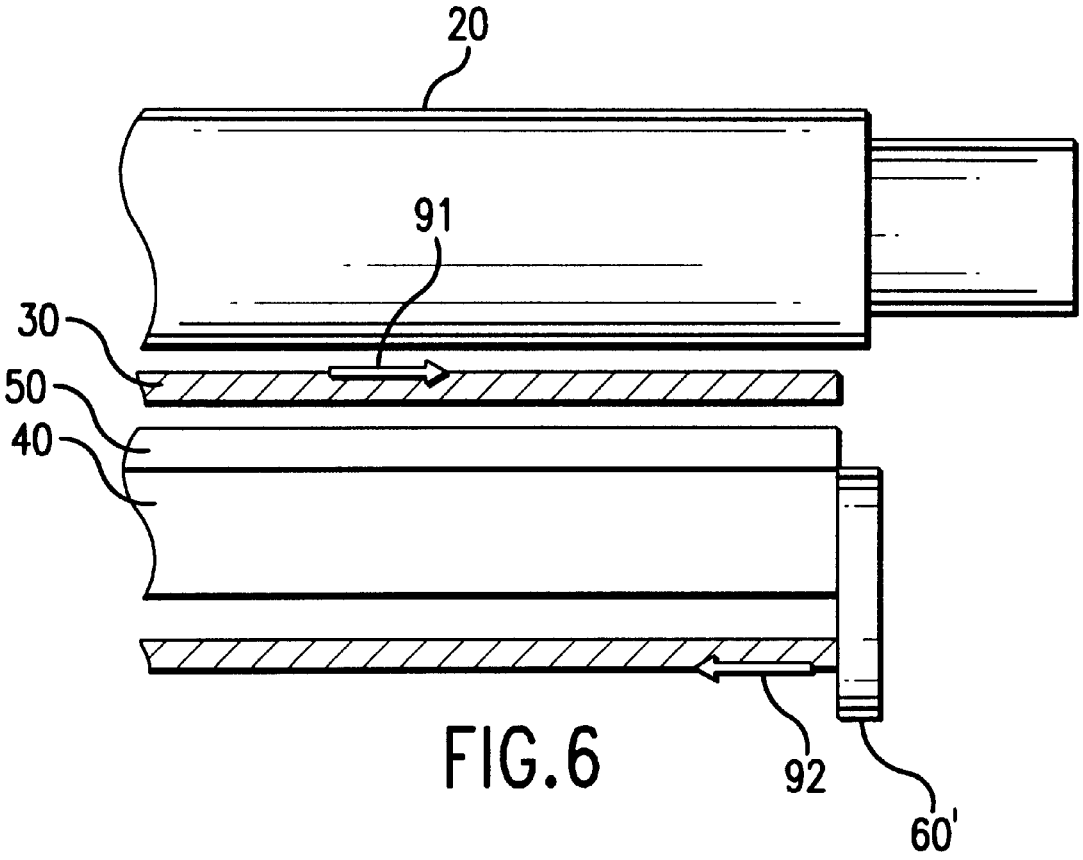
FIG. 6 is a partial view showing the cooperation of a fixation apparatus in which a belt walk guide is not positioned on a line extending through the contact nip region and parallel to the central longitudinal axis of the heating roll.

In another configuration shown in FIG. 6 in which a belt walk guide 60' is not positioned on an axis parallel to an axis of the heating roll and passing through the contact nip region, the walking force 91 of the endless belt 30 and the walk limiting force 92 from the belt walk guide 60' are not collinear. Consequently, a moment acts on the belt. It has been observed that because of this moment and with resin belts, twisting and warping occur in the belt under relatively weak walking forces, and the belt edge buckles.

Figure 4:
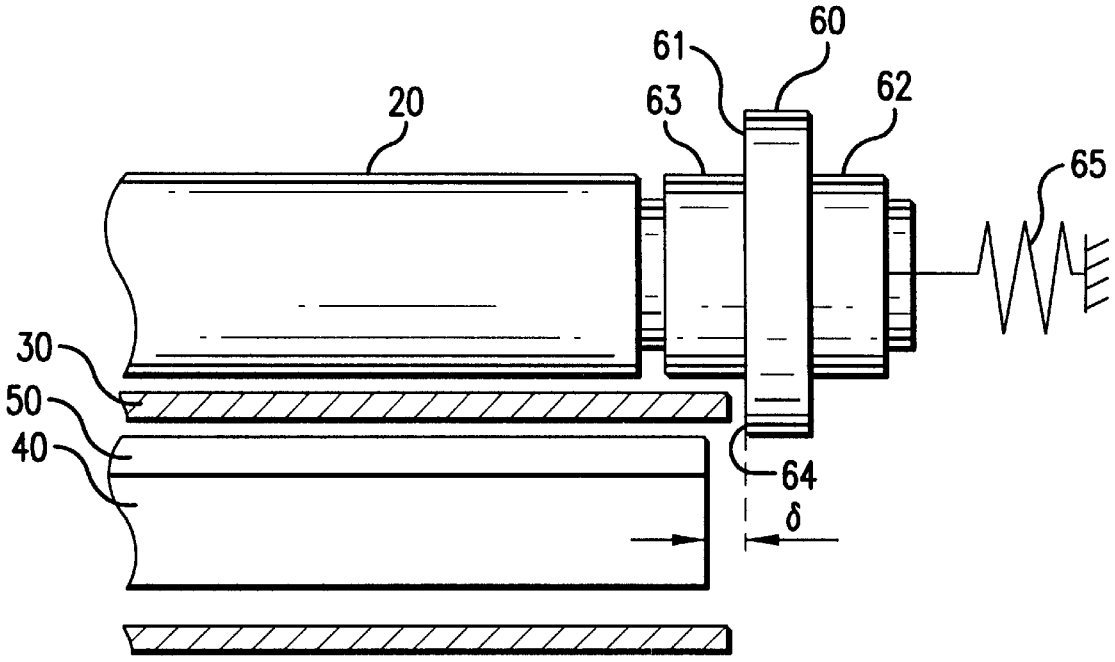
FIG. 4 is a partial view of the fixation apparatus of FIG. 3 showing the gap 8 formed between the belt walk guide and an edge of the pressing member according to the invention.
Figure 5:
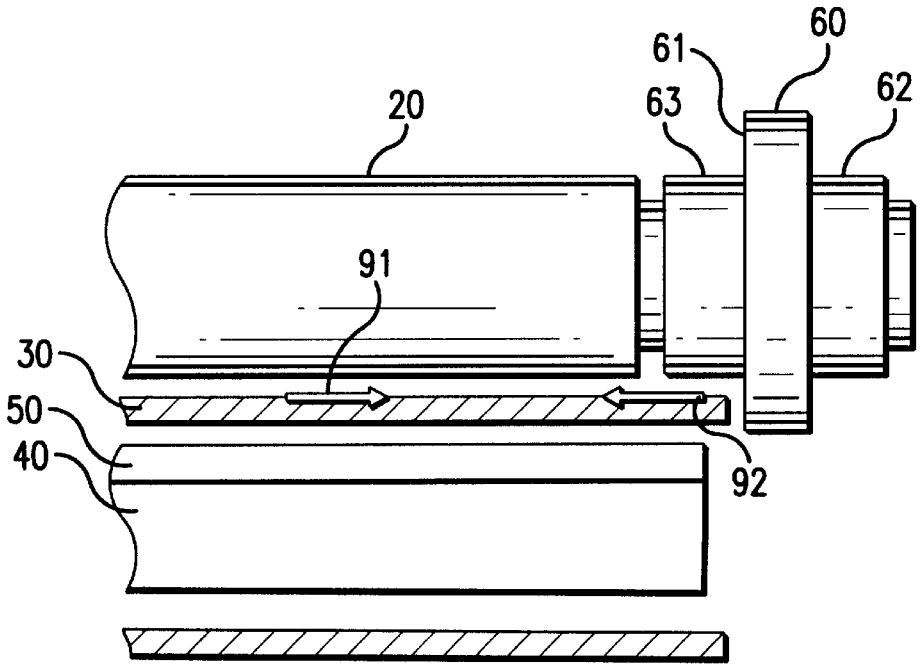
FIG. 5 is a partial view of the fixation apparatus of FIG. 3 explaining the operation of the fixation apparatus.

In addition, in this embodiment, the contact nip region of the endless belt 30 has a larger belt rigidity. Consequently, buckling of the belt occurs in the gap δ that can form between the walk guide surface 64 of the belt walk guide 60 and the edge of the pressing member 50, as shown in FIG. 4. The smaller this gap δ is, the more difficult it is for buckling to occur.

However, in this embodiment, the collar 63 of the belt walk guide 60 acts as a spacer for preventing buckling toward the heating roll 20 side of the endless belt 30 edge. Buckling of the endless belt 20 edge is limited to buckling on the side separated from the heating roll 20.

Figure 7:
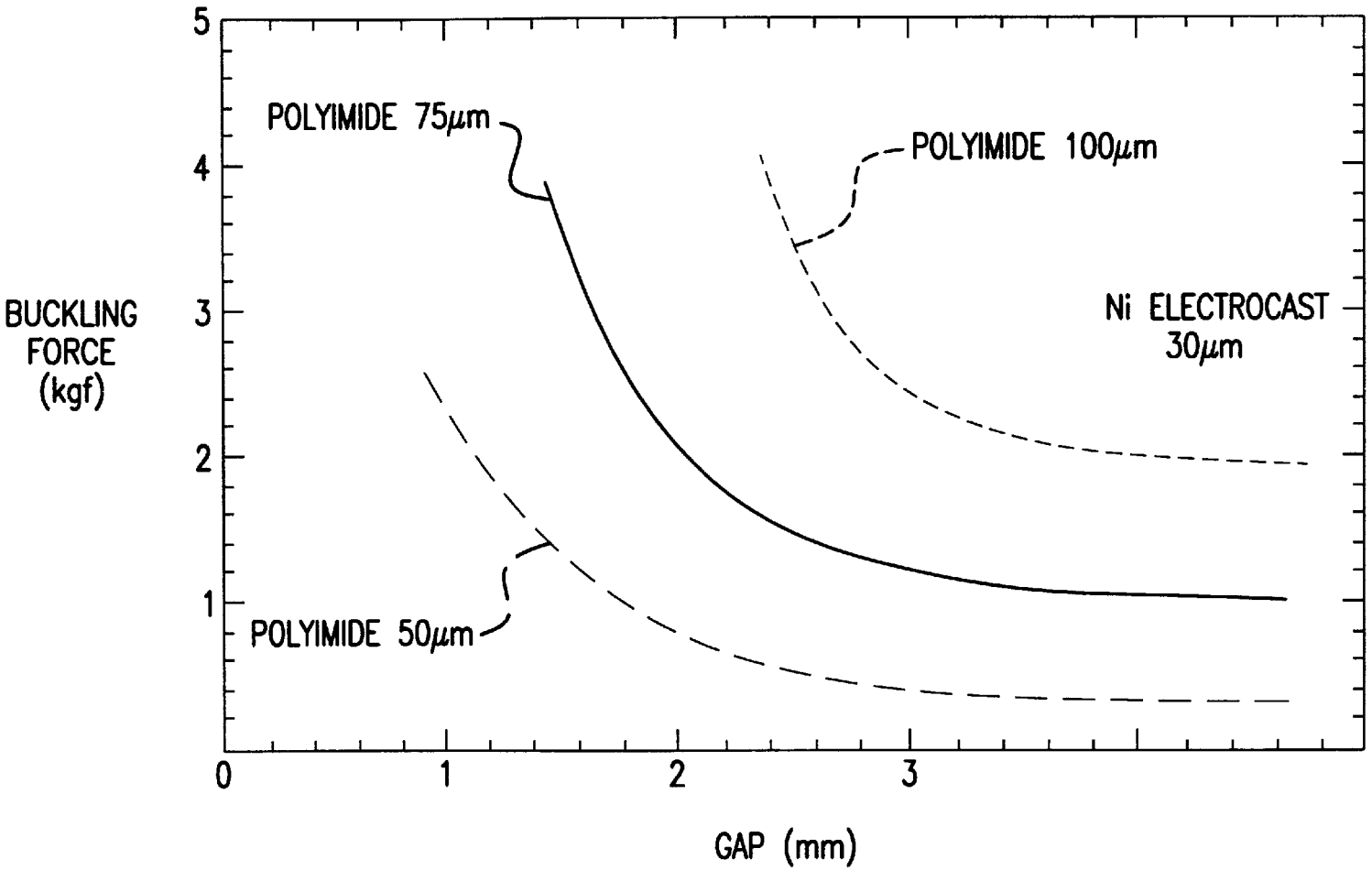
FIG. 7 is a graph showing the relationship between the belt edge and the gap between the pressing member and the belt walk guide, with the belt thickness as a parameter, according to the fixation apparatus of FIG. 2.
Figure 8:
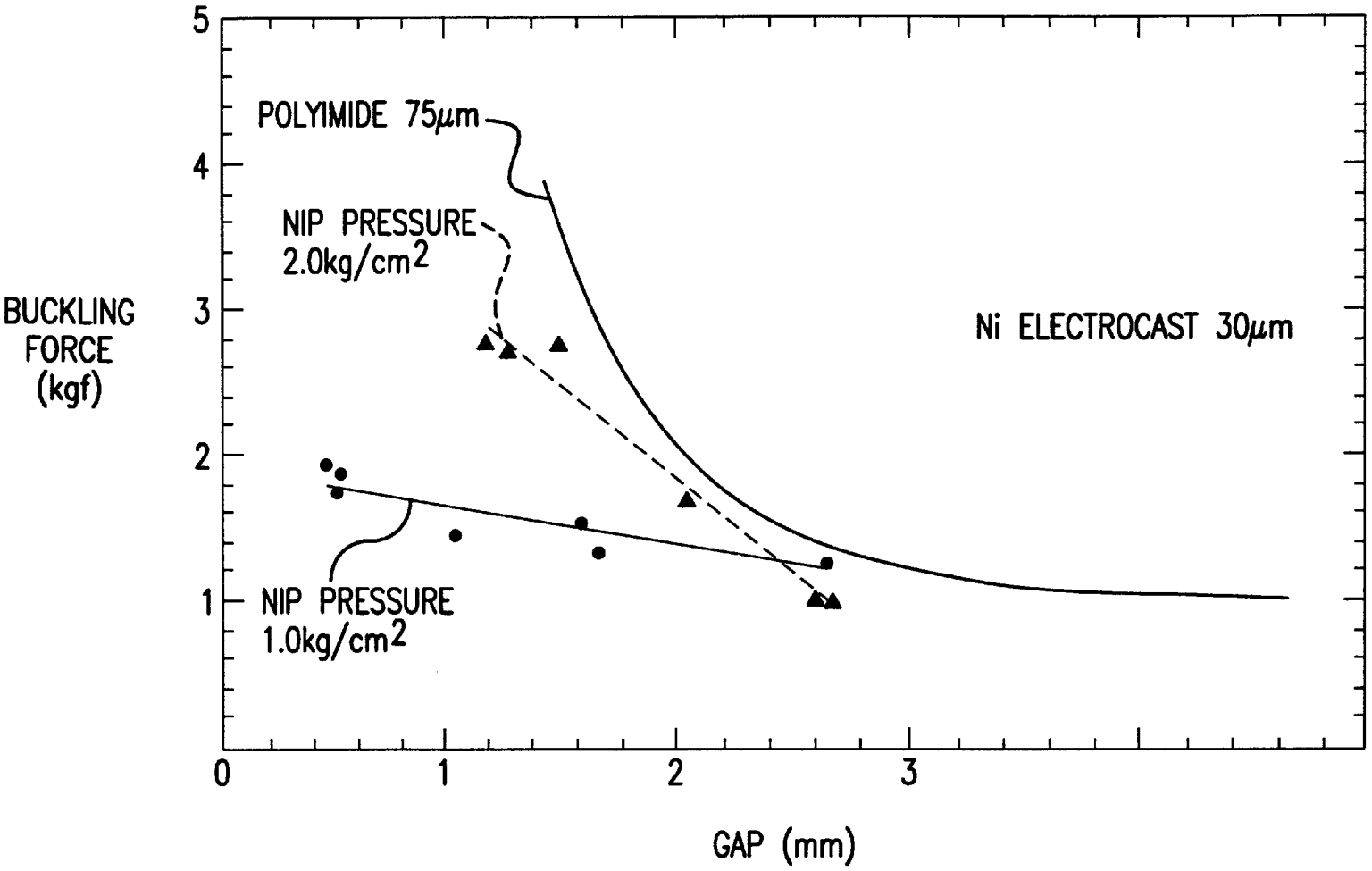
FIG. 8 is a graph showing the relationship between the belt edge and the gap between the pressing member and the belt walk guide, with the nip pressure as a parameter, according to the fixation apparatus of FIG. 2.

FIG. 7 and FIG. 8 show the results of examining the relationship between the gap δ and the buckling force of the belt edge (the minimum force at which buckling occurs in the belt edge). The curves in FIG. 7 represent the calculations of the buckling force F as the size of the above-described gap is adjusted, in three types of polyimide belts of thickness 50 μm, 75 μm and 100 μm. The model used in the calculations is buckling of the belt with one edge completely anchored to the contact nip region and the other edge being a free edge. The gap δ means the free length of the belt.

In this model, the buckling force of the belt can be expressed by the following equation (1).

$$F=C\cdot\pi^2\cdot E\bullet I/L^2 \quad (1)$$

Here, the anchoring condition is C=2.0458, E is the Young's Modulus, I is the cross-sectional second-order moment and L is the gap.

From this relationship, it can be seen that the smaller the gap, the larger the buckling force, that is, the more difficult for buckling to occur. The buckling force is around 2.5 kg for a nickel electrocast belt of 30 μm thickness when not interposed in the contact nip region. However, with a polyimide belt of 75 μm thickness, it is possible to obtain a buckling force of at least as great as in the nickel electrocast belt of 30 μm thickness by making the gap around 1.5 mm or less. In addition, if the gap is made 1.0 mm or less, it is possible to obtain a buckling force at least as great as that of a nickel electrocast belt of 30 μm thickness even with a 50 μm thick polyimide belt. Thus, it is possible to use resin belts with comparatively low rigidity such as polyimide or polytetrafluoroethylene without buckling occurring.

FIG. 8 shows the results of measuring the size of the gap δ and the force causing buckling as the pressure of the nip changed. As shown FIG. 8, the buckling force is large the larger the nip pressure. This shows that the larger the nip pressure, the closer one edge of equation (1) is to the perfectly anchored model. Conversely, as the nip pressure becomes smaller, the belt shifts even in the nip, and consequently this means that the gap in reality becomes larger. Through this, it can be seen that making the pressure of the nip edge, outside the running region of the recording sheet, larger than the pressure of the recording sheet running region is effective for increasing the buckling force.

On the basis of these experimental results, the following results were obtained by analyzing the conditions in which the belt edge did not buckle.

That is, when the walking force created in the belt is larger than the buckling force of the belt edge, the edge of the belt buckles. Normally, the walking force is 0.4–0.5 kg, and consequently, walk control with a belt made of polyimide with a thickness of 75 mm is possible depending on the size of the gap.

However, in unexpectedly bad conditions, such as the drying up of the heating roll (e.g., fixation roll) surface lubricant, a maximum walking force of 1.4 kg occurs. With a polyimide belt of thickness 75 mm, buckling occurs with a force of around 1 kg when the contact nip region is not pressed. Consequently, buckling occurs at the maximum walking force of 1.4 kg. However, by pressing the belt at the contact nip region and making this gap 1.5 mm or less, it is possible to prevent buckling of the belt edge even under the worst conditions.

In order to reduce the gap to the extent possible, it is possible to make the common difference of the walk guide surface 64 attached to both edges of the heating roll 20 0.6 mm by adding the 0.3 mm common difference of the walk guide unit 61 to the 0.3 mm frame common difference. This is accomplished by integrally forming the belt walk guide unit 61 and the bushing unit 62 of the bearing. In addition, it is possible to make the total 1.4 mm or less by adding the 0.5 mm common difference in the length of the pressing member 50 and the 0.3 mm attachment common difference of the pressing member. When this common difference (that is, the gap) is 1.5 mm or less, no buckling occurs because the buckling force of 75 μm thick polyimide is larger than the maximum walking force.

heating roll 20, the common difference of attachment to the heating roll is 0.5 mm in two locations, resulting in 1.3 by adding the 0.3 mm common difference of the walk guide unit 61. When the 0.5 mm common difference in the length of the pressing member 50 and the 0.3 mm common difference in the pressing member 50 are added, the maximum becomes 2.1 mm. If the gap is made to be 0.5 mm or less, it is possible to use a less expensive 50 μm thick polyimide belt without buckling occurring.

With respect to the belt walking force, the heating roll (fixation roll) 20 exerts a force (walking force) on endless belt 30 in the contact nip region and this causes walking. When the edge of the endless belt 30 collides with the belt walk guide 60, the edge of the endless belt 30 receives a force (walk limiting force) from the belt walk guide 60, so that walking is limited.

Figure 9:
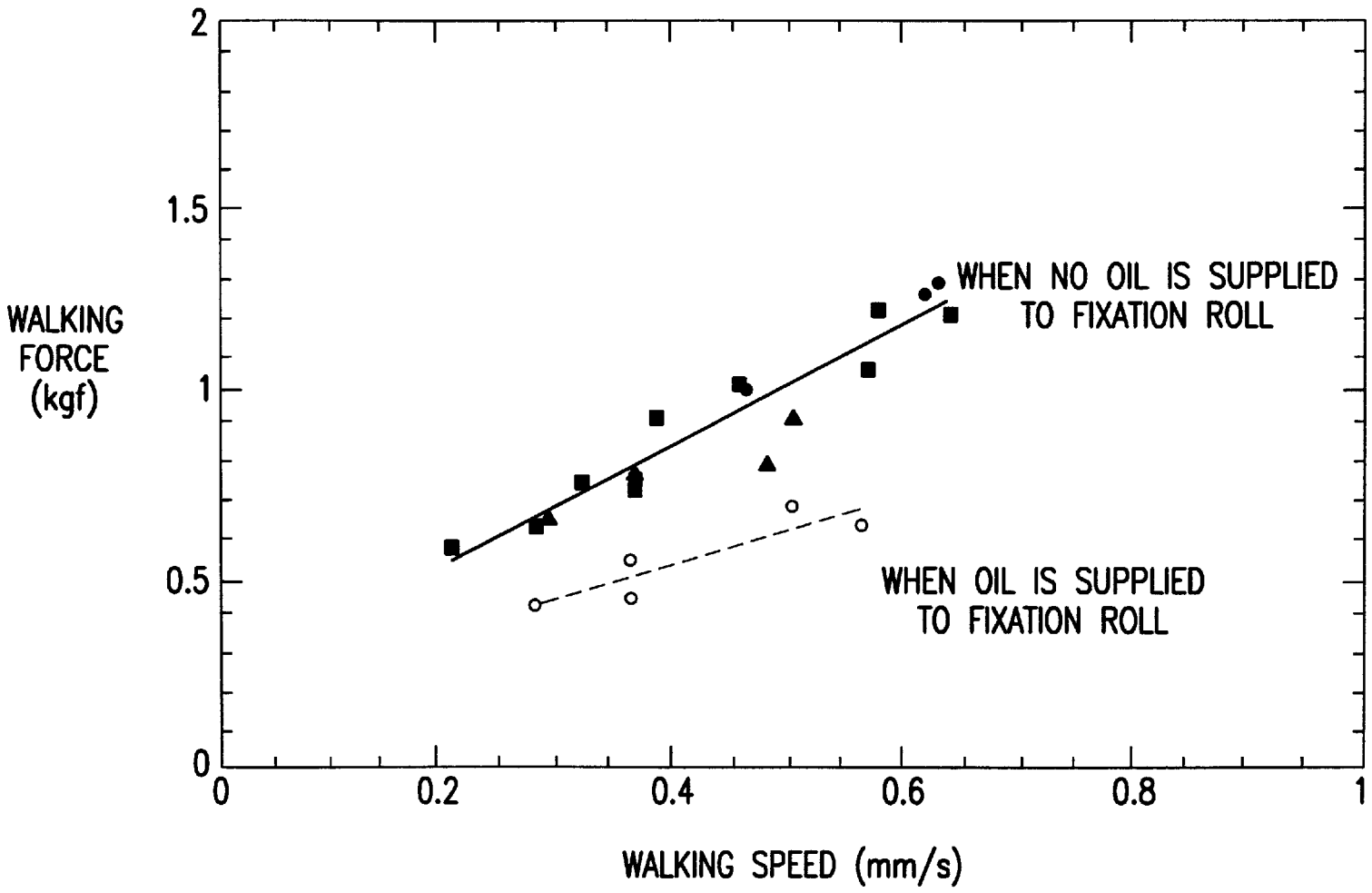
FIG. 9 is a graph showing the relationship between the walking speed of the belt and the walking force of the belt according to the fixation apparatus of FIG. 2.

The walking force of the endless belt 30 has a linear relationship with the walking speed of the belt, as shown in FIG. 9. The walking force is larger the larger the walking speed. Walking is prevented by eliminating slipping between the heating roll 20 and the endless belt 30. Consequently, the relationship is changed by changes in the oil supply quantity to the heating roll 20, and more specifically, changes in the friction coefficient. The endless belt 30 experiences walking due to causes such as the difference in circumferential length between the two belt edges, the load differences on the two nip edges and the degree of parallelness of the heating roll 20 and the endless belt 30. Reducing the walking speed and walking force by increasing the precision of these parameters is important.

Further, the cut of the edges of the endless belt 30 cannot be made perfectly at right angles to the belt axis, such that somewhat of a slope is maintained. In addition, because there are also cases in which the endless belt 30 is set askew, the belt edge is not perfectly parallel with the walk guide surface 64. Consequently, the walking speed of the belt edge is composed of a constant component walking speed with which the apparent belt walking speed caused by the slope of the belt edge is superimposed with a varying component.

Figure 10A:
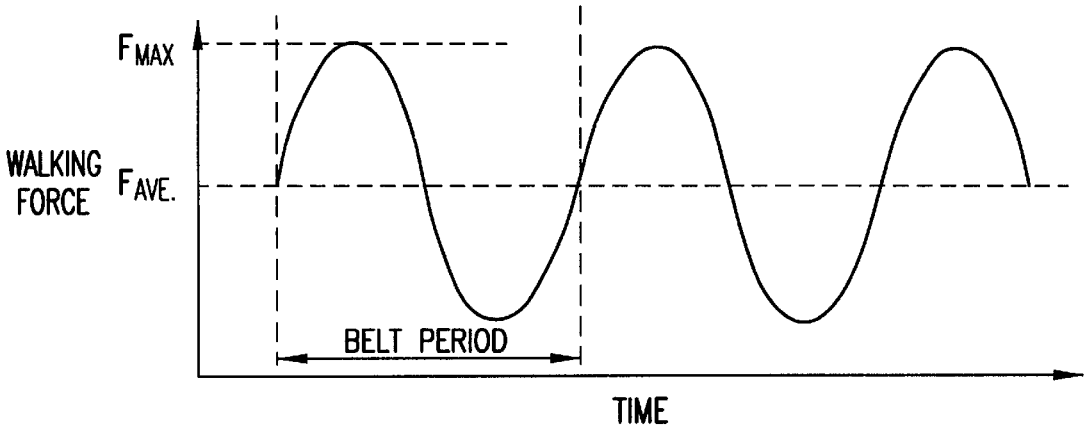
FIG. 10*a* is a graph showing the time change in the walking force when an energizing spring is not used to press the belt walk guide in the direction of the endless belt according to he invention.

Accordingly, the walking force is also such that a varying component is added to the constant component force $F_{ave}$ resulting in the maximum value $F_{max}$, as shown in FIG. 10*a*. It is possible to reduce the varying component if the edge of the endless belt 30 approaches parallel to the walk guide surface 64. $F_{max}$ then approaches $F_{ave}$.

Figure 10B:
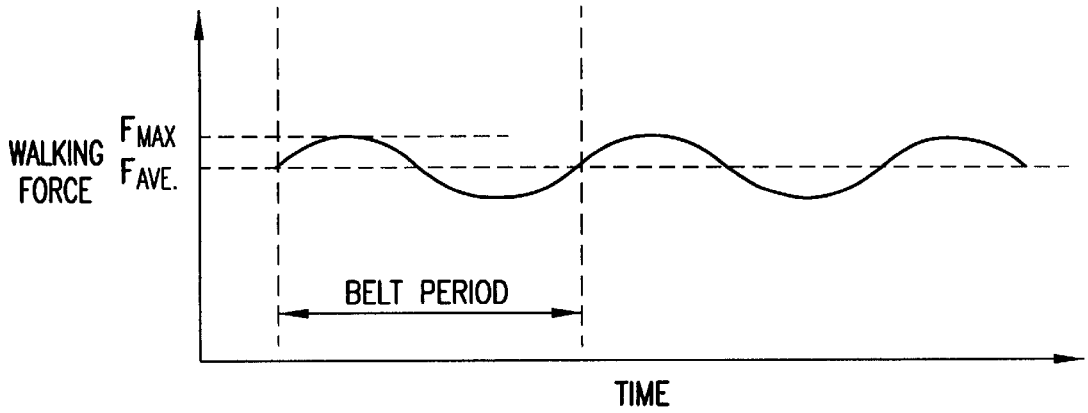
FIG. 10*b* is a graph showing the time change in the walking force when an energizing spring is used to press the belt walk guide in the direction of the endless belt according to the invention.

In order to smooth the varying component of the walking force, the belt walk guide 60 is movably attached to the heating roll 20, and is pressed in the direction of the endless belt 30 by the energizing spring 65. Using this arrangement, $F_{max}$ of the walking force of FIG. 10*a* can be reduced, as shown in FIG. 10*b*.

However, because $F_{ave}$ depends on the walking speed of the belt, $F_{ave}$ does not change. In addition, the difference between $F_{max}$ and $F_{ave}$ can be made as small as possible by optimizing the elastic coefficient of the energizing spring 65.

Figure 11:
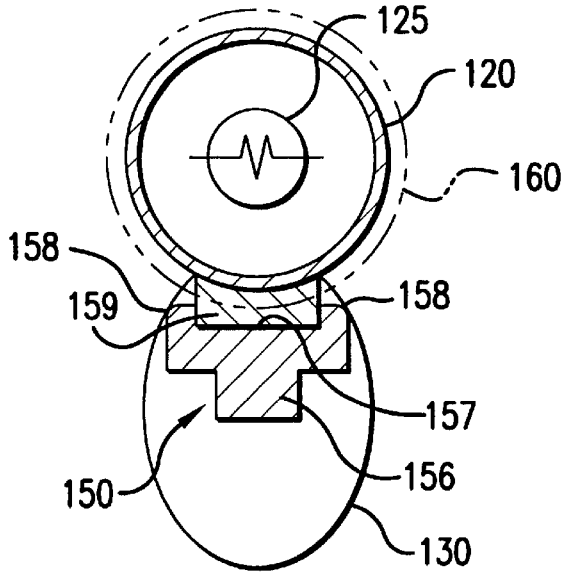
FIG. 11 is a cross-sectional side view of a fixation apparatus according to another preferred embodiment of the invention.

FIG. 11 is a cross-sectional side view of another embodiment of the fixation apparatus of the invention. In this embodiment, the fixation apparatus is roughly the same as the embodiments of FIGS. 1–10. However, the surface of the heating roll 120 has a rigid hard roll composition. Also, a pressing member 150, on which an elastic body 159 is adhered to within the indentation 157 on the anchored table 156, is provided inside the endless belt 130. The contact nip region between the heating roll 120 and the endless belt 130 is formed by elastic deformation of the elastic body 159 of the pressing member 150. An embracing part 158 including both side walls of the indentation 157 functions as a belt running guide with respect to the elastic body 159 of the anchored table 156. Elements that are the same as those in the embodiment of FIGS. 1–10 are labeled similarly as those in the embodiment of FIG. 11, and description of these elements is omitted here.

Additionally, in the embodiment of FIG. 11, a heating roll 120 having the same composition as in the embodiment of FIGS. 1–10 is used. In consideration of making running of the endless belt 130 more stable, the same belt running guide 40 as in the embodiment of FIGS. 2–6 is separately provided. Also, it is possible to alter the design appropriately such as by using an elastically energized movable table in place of the anchored table 56 as the pressing member 150.

Figure 12:
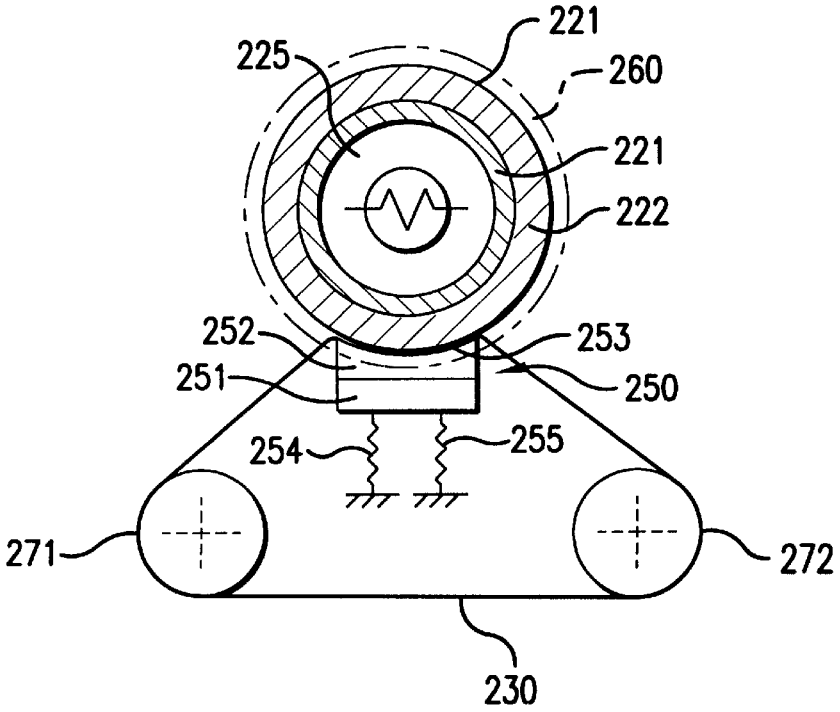
FIG. 12 is a side view of a fixation apparatus according to yet another preferred embodiment of the invention.

FIG. 12 is a cross-sectional side view of another embodiment of the fixation apparatus of the invention. In this embodiment, the fixation apparatus is roughly the same as in the embodiment of FIGS. 1–10, but, the endless belt 30 is suspended by rolls 71 and 72 besides the pressing member 50. With this structure, it is preferable to implement a heat-insulating process on the rolls 71 and 72 in order to suppress, to the extent possible, the radiation of heat from the rolls 71 and 72. As with the previous embodiments, elements that are the same as those in the previous embodiments are labelled similarly, and the description of these elements is omitted here.

Figure 13:
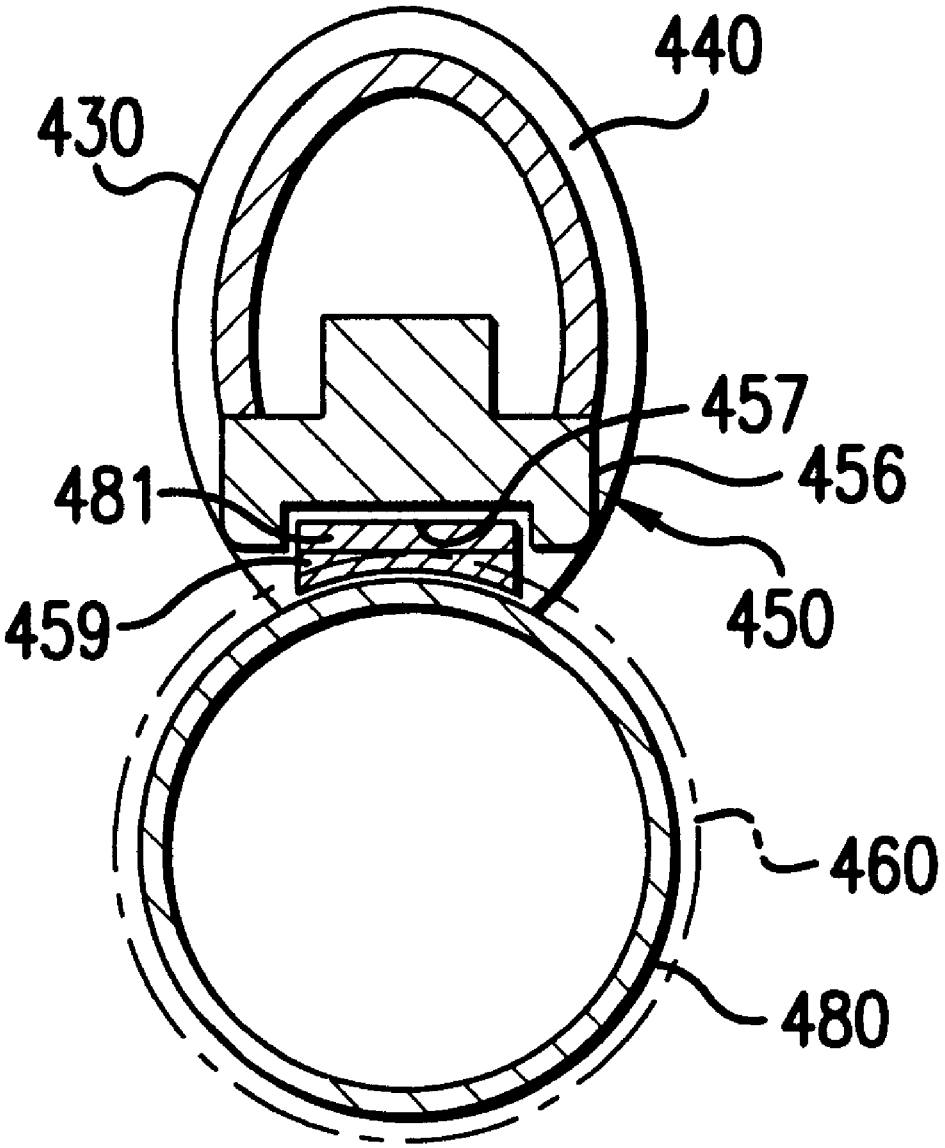
FIG. 13 is a cross-sectional side view of a fixation apparatus according to still another preferred embodiment of the invention.

FIG. 13 is a cross-sectional side view of another embodiment of the fixation apparatus of the invention. The fixation apparatus according to this embodiment differs from the above embodiments and comprises a pressure roll 480 that is rotationally driven; an endless belt 430 that is pressed against the pressure roll 480 and rotates in concert therewith; a pressing member 450 that is provided inside the endless belt 430 and that presses the endless belt toward the pressure roll 480 thereby forming a contact nip region between the endless belt 430 and the pressure roll 480; and a heater 481 that heats the endless belt 430.

In this embodiment, the surface of the pressure roll 480 has a rigid hard roll composition, and a ring-shaped belt walk guide 460, of the same composition as in the embodiment of FIGS. 1–10, is provided on both sides of the contact nip region in the shaft direction.

In addition, the pressing member 450 houses an elastic body 459 in an indentation 457 on the anchored table 456. The contact nip region between the pressure roll 480 and the endless belt 430 is formed by elastic deformation of the elastic body 459.

Furthermore, the same belt running guide 40 as in the embodiment of FIGS. 2–6 is provided inside the endless belt 430. This stabilizes the running of the endless belt 430 while maintaining the shape of the endless belt 430. Furthermore, in this embodiment a plate-type heater is used as the heater 481. This heater is housed at the bottom of the indentation of the anchored table 456 of the pressing member 450 and heats the endless belt 430 through the elastic body 459. In this embodiment, walking of the endless belt 430 is limited with certainty by the belt walk guide 460. Obviously, in this embodiment appropriate design alterations can be made such as changing the composition of the pressing member 450 or the composition of the heater 481.

Figure 14:
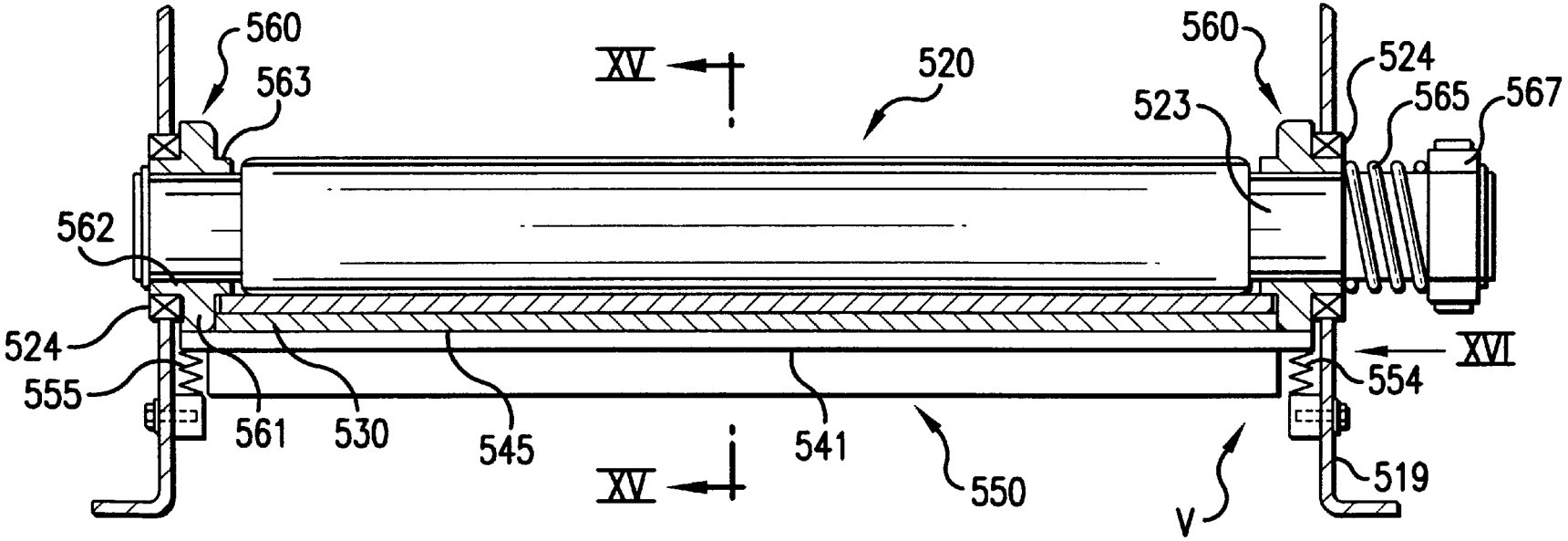
FIG. 14 is a frontal partial cross-sectional view of the fixation apparatus according to an additional preferred embodiment of the invention.
Figure 15:
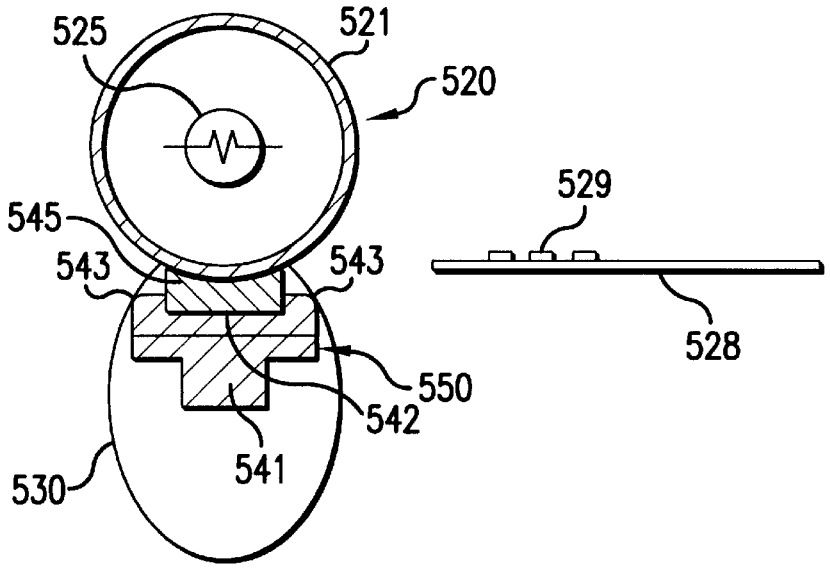
FIG. 15 is a cross-sectional view taken along line XV—XV in FIG. 14.
Figure 16:
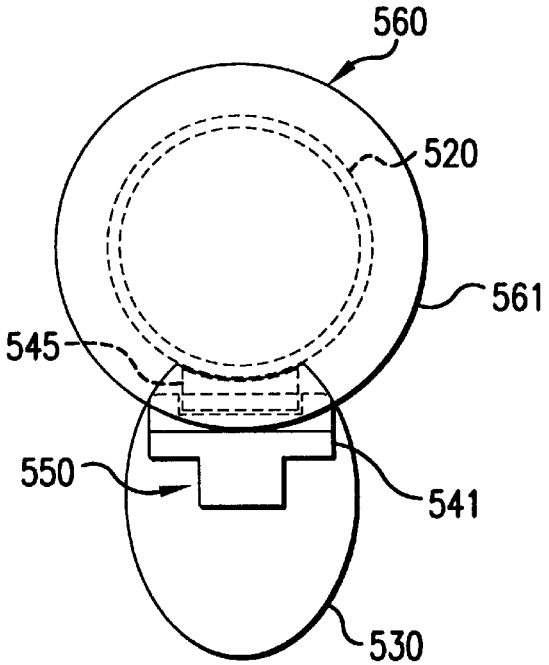
FIG. 16 is a side view showing the arrangement of the heating roll, endless belt, pressing member and belt walk guide of the fixation apparatus of FIG. 14 as viewed from direction XVI in FIG. 14.

FIG. 14 is a partial cross-sectional frontal view of another embodiment of the fixation apparatus of the invention. FIG. 15 is a cross-sectional view along line XV—XV in FIG. 14. FIG. 16 is a view from direction XVI in FIG. 14.

In these drawings, the fixation apparatus comprises a heating roll 520 that is rotationally driven; an endless belt 530 that makes contact with the heating roll 520 and rotates in concert with this heating roll 520; and a pressing member 50 that is arranged on the inside of the endless belt 530; and that presses the endless belt 530 against the heating roll 520, thereby forming a contact nip region between the endless belt 30 and the heating roll 520.

The core 521 of the heating roll 520 is preferably an aluminum cylinder with a preferred outer diameter of approximately 34 mm, a preferred inner diameter of approximately 32 mm and a preferred length of approximately 350 mm. The surface of the core 521 is preferably HTV silicone rubber of a preferred hardness approximately 45° (JIS-A) directly coated with a preferred thickness of approximately 1 mm as a foundation layer. Further, on the top of this layer RTV silicon rubber is dip coated to a preferred thickness of approximately 50 mm as a top coat layer. Through this, a covering layer (not shown) is formed. This covering layer is finished to a nearly mirror-like surface.

In this embodiment, the hardness of the rubber of the foundation layer is the result of measuring the hardness by applying a load of 1,000 gf in conformance with JIS K6301 using a spring type A-type hardness gauge made by Teclock. For the core 521, a metal component with high thermal conductivity other than aluminum may be used. For the covering layer, another material may be used if such material is an elastic body with high heat resistance.

Inside the core 521, a halogen lamp 525 with 850 W output is arranged as a heat source. In addition, a temperature sensor (not shown) is arranged on the surface of the heating roll 520, and measures the temperature of this surface. Furthermore, the halogen lamp 525 is feedback controlled by an temperature controller (not shown) through measurement signals from the temperature sensor, so that the surface of the heating roll 520 is adjusted to approximately 150° C., for example.

In addition, an oil supply apparatus (not shown) is provided near the heating roll 520, and supplies a fixed quantity of a surface lubricant to the surface of the heating roll 520. Through this arrangement, when an unfixed toner image 529 is fixed to a recording sheet 528, offsetting of a portion of the toner by the heating roll 520 is prevented.

Furthermore, both edges of the heating roll 520 are structured as a slightly constricted support shaft 523. A generally ring-shaped belt walk guide 560 is inserted onto this support shaft 523 and is rotationally supported by a bearing 524 mounted in a bearing opening of the anchored frame 519.

In addition, the endless belt 530 is preferably formed from a polyimide film with a preferred thickness of approximately 75 $\mu$m, a preferred width of approximately 300 mm and a preferred perimeter length of approximately 125 mm. A lubricating layer of PTFE (polytetrafluoroethylene) is formed on the outer perimeter surface. The endless belt 30 is nipped only between the pressing member 550 and the heating roll 520, and is wrapped with no tension.

The pressing member 550 is arranged such that the movable support table 541 that extends in the shaft direction of the heating roll 520 is elastically energized toward a side adjacent the heating roll 520 by a pair of support springs, for example, compression coil springs 554 and 555. An indentation 542 is formed in the movable support table 541 and an elastic body of predetermined thickness is adhered inside this indentation 542. In this embodiment, silicone rubber with a hardness of approximately 23° (JIS-A), for example, is used as the elastic body 545. A low friction layer (not shown) is provided on the surface thereof, that is on surface which contacts with the endless belt 30.

In this embodiment, "FGF-400-4" (trade name) produced by Chuko Kasei is used as the low friction layer and is glass fiber sheet impregnated with polytetrafluoroethylene. Dimethyl silicone oil (trade name "KF-96") made by Shin'etsu Chemical Co. with a viscosity of 1000 cs is coated onto the surface of the low friction layer to reduce the friction coefficient between the endless belt 530 and the pressing member 550.

Furthermore, the elastic body 545 of the pressing member 550 is softer than the foundation layer of the heating roll 520, and hence deforms easily. Thus the endless belt 530 deforms in the opposite direction from the cylindrical shape of the belt at the contact nip region. Accordingly, the cross-sectional second-order moment becomes large and the buckling strength becomes large.

In addition, the movable support table 541 is, for example, made of heat-resistant resin. The embracing unit 543 of the elastic body 545 which includes both side walls of the indentation 542 linearly contacts the inner surface of the endless belt 530 with a small contact surface area and functions as a belt walk guide.

In this embodiment, one part of the movable table 541 functions as a belt walk guide, but a separate belt walk guide may also be provided. However, the material of the belt walk guide preferably has a certain degree of rigidity, does not take too much heat from the endless belt 530, and does not hinder the running of the endless belt 530.

Figure 17B:
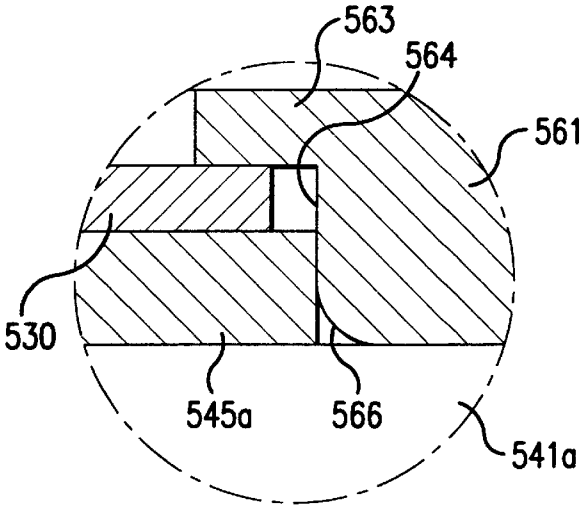
FIG. 17 is a partial view of the fixation apparatus of FIG. 14 with a portion shown in exploded view.
Figure 17A:
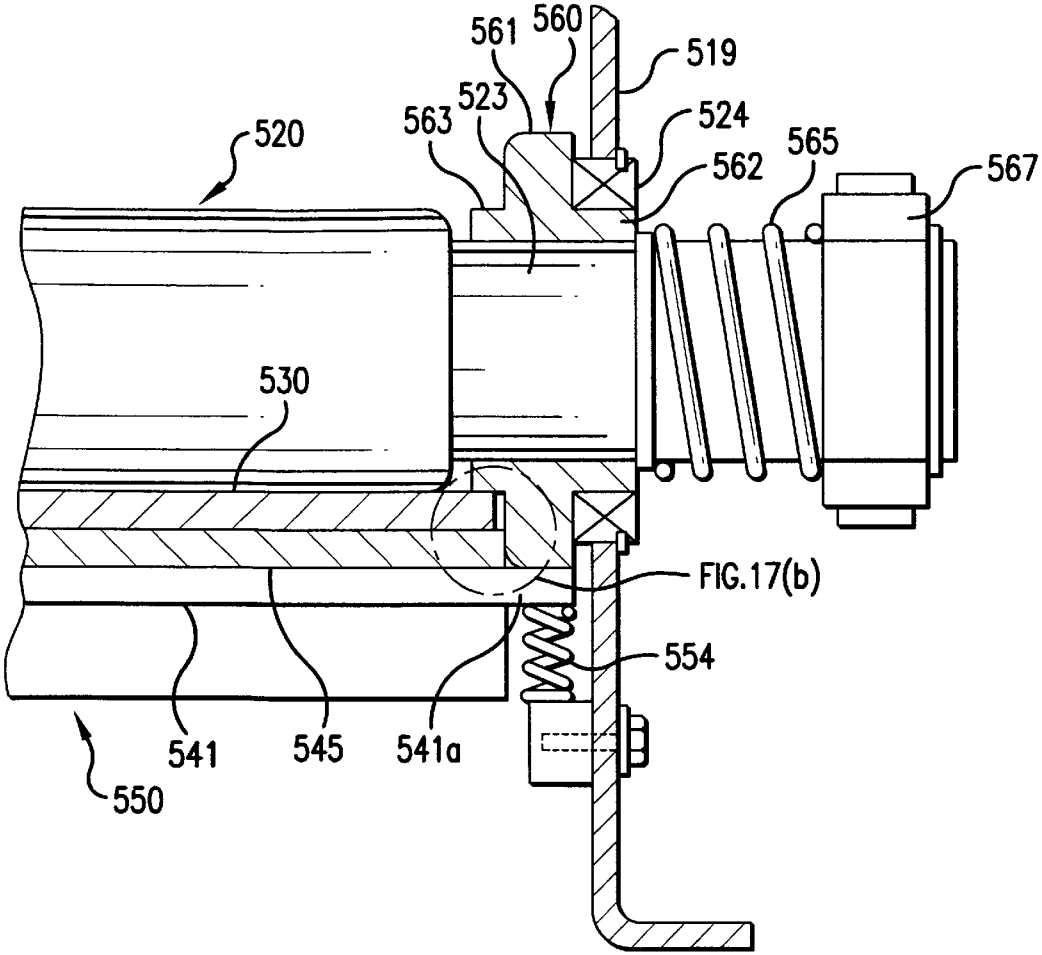

In the invention, the belt walk guide 560 is positioned on support shaft 523 of the heating roll 520. The belt walk guide 560 comprises a ring-shaped member made of polyimide, the outer diameter of which varies as shown in FIG. 17, and is integrally formed with a walk guide unit 561 with a preferred larger outer diameter of approximately 50 mm. A bushing 562 of a preferred middle outer diameter of approximately 33 mm is inserted inside the bearing 524 at a position to the outside of the walk guide unit 561 in the direction of the shaft. A collar 563 of a preferred smaller outer diameter of approximately 35 mm is positioned inside of the walk guide unit 561 in the direction of the shaft.

Further, the walk guide unit 561 has a walk limiting surface 564 facing the edge of the endless belt 30. In addition, in this embodiment, the edge of the elastic body 545 of the pressing member has an extension 545*a* that extends farther than the edge of the endless belt 530. The edge of elastic body extension 545*a* is arranged in contact with the above-described walk limiting surface 564. Alternatively, the inner surface of the heating roll 520 at the edge of the endless belt 530 is arranged in contact with the perimeter surface of the collar 563.

Furthermore, in this embodiment, the edge of the movable support table 541 has an extension 541*a* that extends farther than the edge of the elastic body 545. This movable support table extension 541*a* is arranged in contact with the perimeter surface of the walk guide unit 561.

Furthermore, in this embodiment, the walk guide unit 561 has a curved surface 566 with a predetermined curvature at a position facing the elastic body extension 545*a* and the movable support table extension 541*a*. By this arrangement, the contact resistance of the pressing member 550 with the elastic body 550 and movable support table 541 is reduced. In addition, the curved surface 566 also functions as a guide surface when integrating the pressing member 550 and the heating roll 520, to which the belt walk guide 560 is priorly integrated. Consequently, this arrangement aids in improving the ease of integration when producing the fixation apparatus. In addition, in this embodiment, the belt walk guide 560 is provided so as to be movable in the shaft direction with respect to the heating roll 520, and is pressed in the direction of the endless belt 530 by energizing spring 565. In FIG. 14 and FIG. 17, a drive transfer gear 567 is used to transfer the rotational drive force to the heating roll 520.

With reference to the operation of the fixation apparatus and FIG. 14 and FIG. 15, the heating roll 520 is caused to rotate at a circumferential speed V=160 mm/s by a motor (not shown). Because of this rotation, the endless belt 30 is also caused to rotate in concert at a speed of 160 mm/s. The toner image 529 is imprinted onto the recording sheet 528 by an imprinting apparatus (not shown), and the recording sheet 528 is conveyed toward the contact nip region. Furthermore, when the recording sheet 528 enters the contact nip region of the fixation apparatus, the toner image 529 is fixed onto the recording sheet 528 by pressure that acts in the contact nip region and heat given off by the halogen lamp 525 through the heating roll 520, as shown in FIG. 15 and FIG. 18.

In this embodiment, during wait times and empty run times of the fixation apparatus, the movable support table 541 is elastically energized by the support springs 554 and 555, makes contact with the perimeter surface of the walk guide unit 561 of the belt walk guide, and is restricted in position, as shown in FIG. 14. Consequently, if the thickness of the elastic body 545 of the pressing member 50, the elastic coefficient, and the positional relationship between the endless belt 530 and the movable support table 541 are appropriately adjusted; then the contact force of the elastic body 545 of the pressing member 550 is set weaker to a certain degree and a contact nip region of predetermined width is obtained between the heating roll 520 and the endless belt 530.

Accordingly, in this embodiment, during wait times and empty run times, the pressing force from the pressing member 550 is suppressed to a certain degree. This results in keeping the wear on the perimeter surface of the endless belt 530 and the heating roll 520 to the minimum necessary.

Figure 18:
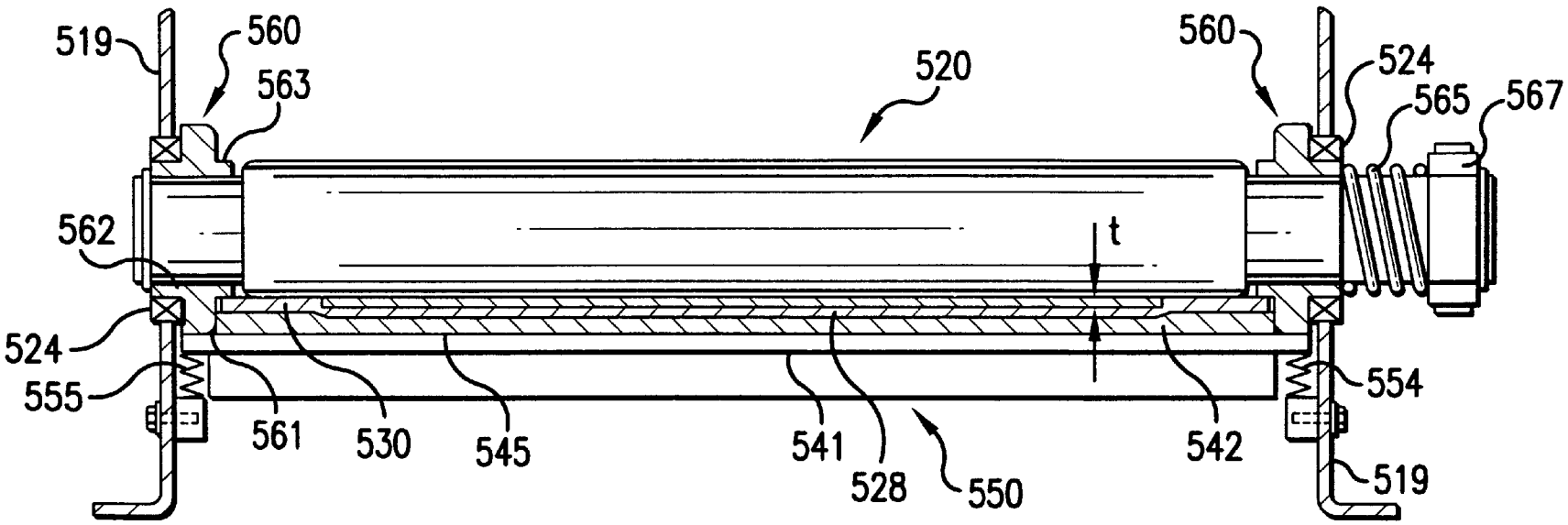
FIG. 18 shows the fixation apparatus of FIG. 14 with a recording sheet passing therethrough.

Alternatively, when the recording sheet 528 enters the contact nip region, the endless belt 530 is pressed against the elastic body 545 of the pressing member 50 by a thickness t of the recording sheet 528, as shown in FIG. 18. The contact force between the inner surface of the endless belt 530 and the elastic body 545 increases, and good fixation action is accomplished with high contact nip pressure. At this time, the contact nip pressure increases, and consequently snaking or mistracking of the endless belt 530 is effectively suppressed. The belt walk guide 560 is pressed toward a side adjacent the endless belt 530 by the energizing spring 565. However, the walk guide unit 561 of the belt walk guide 560 makes contact with the edge of the elastic body 545, as shown in FIG. 17. Consequently, the walk limiting surface 564 of the belt walk guide 560 is positioned in a predetermined position.

In addition, the frictional resistance between the heating roll 520 shaft and the belt walk guide 560 is larger than the frictional resistance between the belt walk guide 560 and the pressing member 550, that is the movable support table 541 and elastic body 545. Consequently, the belt walk guide 560 rotates along with the heating roll 520.

Using this operating procedure, the endless belt 530 is caused to walk in a direction along the belt shaft by the difference in circumferential lengths between the two belt edges and the load difference between the two nip edges, or alternatively, the lack of parallelness between the heating and fixation roll and the belt at the time of installation. Furthermore, walking of the endless belt 530 is limited by the edge of the endless belt 530 colliding with walk guide surface 564 of the belt walk guide 560. The walking force of the endless belt 530 and the walk limiting force from the belt walk guide 560 are collinear. Consequently, the walking force and the walk limiting force cancel each other out, so that no moment acts on the belt. Accordingly, twisting and warping do not occur in the belt.

In a configuration in which a belt walk guide is not positioned on an axis parallel to an axis of the heating roll and passing through the contact nip region, the walking force of the endless belt 530 and the walk limiting force from the belt walk guide are not collinear. Consequently, a moment acts on the belt. It has been observed that because of this moment, in resin belts twisting and warping occur in the belt under relatively weak walking forces resulting in the belt edge buckling.

In this embodiment, the contact nip region of the endless belt 530 has a large belt rigidity. Consequently, buckling of the belt tries to occur at the edge of the endless belt 530. However, in this embodiment, the extension 545*a* of the elastic body 545 makes contact with the walk guide unit 61 of the belt walk guide 560, as shown in FIG. 17, so that the space between the edge of the elastic body 545 and the belt walk guide 560 is covered. Consequently, there is no buckling deformation in the direction of gravity at the edge of the endless belt 530.

In particular, in this embodiment the edge of the endless belt 530 is interposed between the extension 545*a* of the elastic body 545 and the collar 563 of the belt walk guide 560. Consequently, buckling deformation of the edge of the endless belt 530 is prevented with certainty. Consequently, it is possible to use less expensive resin products as the endless belt 530.

Furthermore, the cut of the edges of the endless belt 530 cannot be made to be perfectly at right angles to the belt axis, so that somewhat of a slope is maintained. In addition, because there are also cases in which the endless belt 530 is set askew, the endless belt 530 edge is not perfectly parallel with the walk guide surface 64. Consequently, the walking speed of the endless belt 530 edge is composed of a constant component walking speed with which the apparent belt walking speed caused by the slope of the endless belt 530 edge is superimposed with a varying component.

Figure 19A:
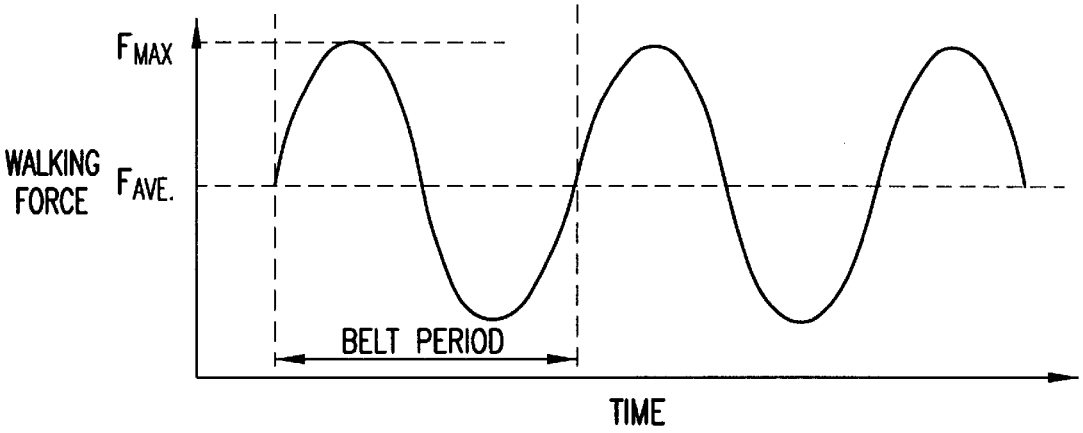
FIG. 19*a* is a graph showing the time change in the walking force when an energizing spring is not used to press the belt walk guide in the direction of the endless belt according to the invention.

Accordingly, the walking force is also such that a varying component is added to the constant component force $F_{ave}$ resulting in the maximum value $F_{max}$, as shown in FIG. 19*a*. It is possible to reduce the varying component if the edge of the endless belt 530 approaches parallel to the walk guide surface 564. $F_{max}$ then approaches $F_{ave}$.

Figure 19B:
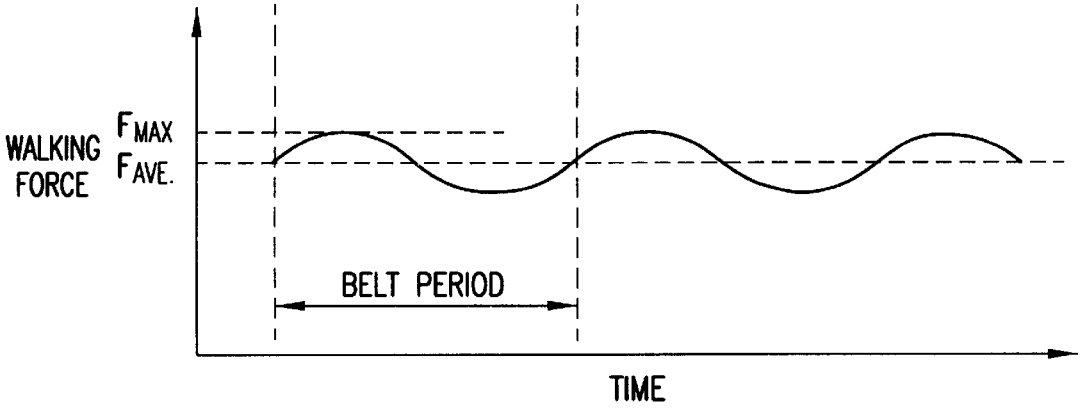
FIG. 19*b* is a graph showing the time change in the walking force when an energizing spring is used to press the belt walk guide in the direction of the endless belt according to the invention.

In order to smooth the varying component of the walking force, the belt walk guide 560 is movably attached to the heating roll 520, and is pressed in the direction of the endless belt 530 by the energizing spring 565. Using this arrangement, $F_{max}$ of the walking force of FIG. 19*a* can be reduced, as shown in FIG. 19*b*.

However, because $F_{ave}$ depends on the walking speed of the belt, $F_{ave}$ does not change. In addition, the difference between $F_{max}$ and $F_{ave}$ can be made as small as possible by optimizing the elastic coefficient of the energizing spring 565.

In addition, in this embodiment, when the belt walk guide 560 is elastically energized by an energizing spring 565, the belt walk guide 560 is regularly in contact with the edge of the elastic body 545 of the pressing member 50 composed of the extension that extends beyond the edge of the endless belt 530 so that the position is determined. As a result, the belt walk guide 560 is not regularly in contact with the edge of the endless belt 530, and wear on the edge of the endless belt 530 is thereby suppressed.

Figure 20:
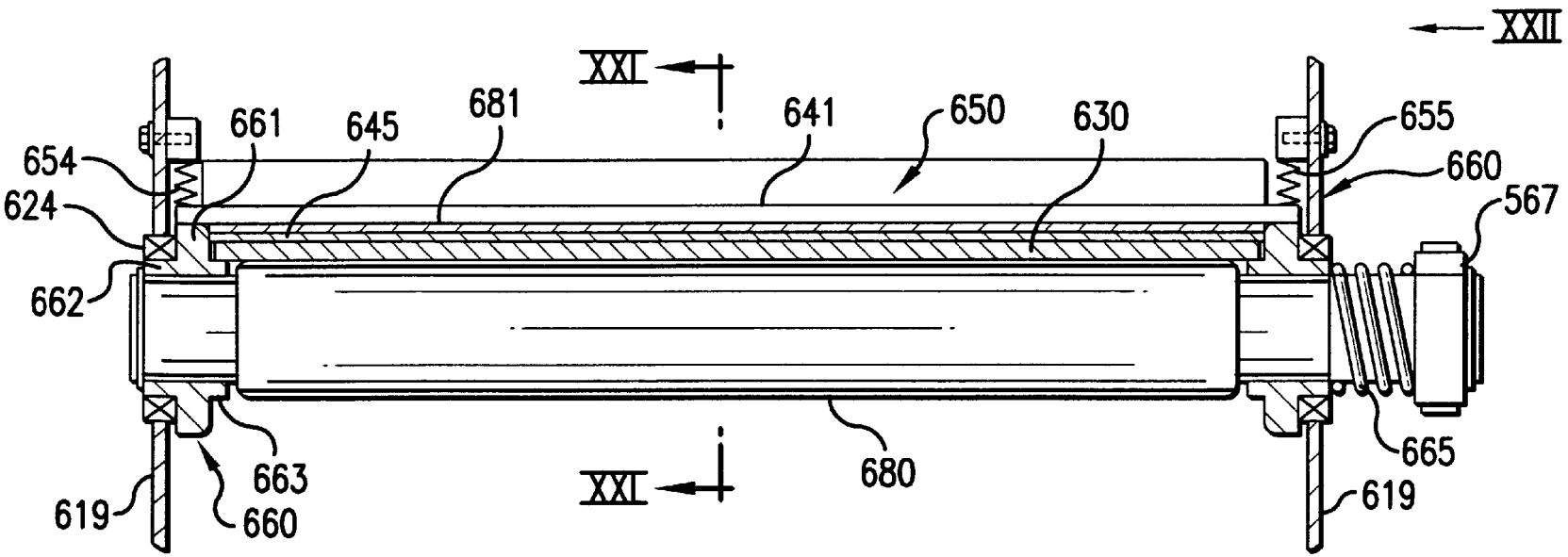
FIG. 20 is a frontal partial cross-sectional view of the fixation apparatus according to a further embodiment of the invention.
Figure 21:
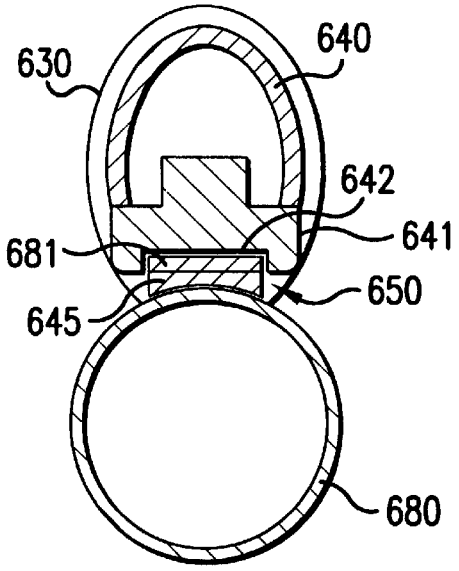
FIG. 21 is a cross-sectional view taken along line XXI—XXI in FIG. 20.
Figure 22:
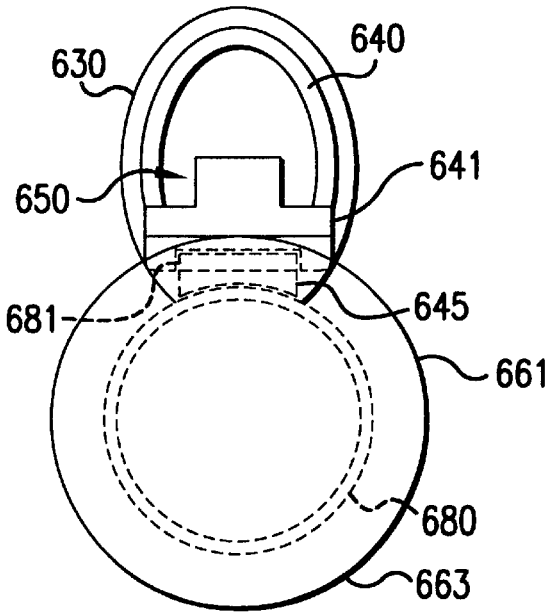
FIG. 22 is a side view showing the arrangement of the endless belt, the belt running guide, the pressing member, the belt walk guide and the pressure roll of the fixation apparatus of FIG. 20 as viewed from the direction XXII in FIG. 20.

FIG. 20 is a frontal partial cross-sectional view of another embodiment of the fixation apparatus of the invention. FIG. 21 and FIG. 22 are respectively a cross-sectional drawing along line XXI–XII in FIG. 20, and a side view from the XXII direction in FIG. 20. Elements the same as in previously discussed embodiments are similarly labeled, and detailed explanation of such elements is omitted here.

The fixation apparatus according to this embodiment comprises a pressure roll 680 that is rotationally driven; an endless belt 30 that is pressed against this pressure roll 680 and rotates in concert therewith; a pressing member 650 that is provided inside this endless belt 30 and that presses the endless belt toward the pressure roll 680 forming a contact nip region between the endless belt 630 and the pressure roll 680; and a heater 681 that heats the endless belt 630.

In this embodiment, the surface of the pressure roll 680 has a rigid hard roll composition. A ring-shaped belt walk guide 660, comprising the same walk guide unit 661, bushing unit 662 and collar 63 as in previous embodiments is provided on this support shaft.

In addition, the pressing member 650 houses an elastic body 645 in an indentation 642 on the movable support table 641, roughly the same as in previous embodiments. The contact nip region between the pressure roll 680 and the endless belt 630 is formed by elastic deformation of the elastic body 645. Further, the belt running guide 640 is provided inside the endless belt 630, and this stabilizes the running of the endless belt 630 while maintaining the shape of the endless belt 630.

The belt running guide 640 is made of a heat-resistant resin, and rib-shaped protrusions are provided in the direction of the circumference on the outer circumferential surface thereof, so that the surface area of contact between the inner circumferential surface of the endless belt 630 and the belt running guide 640 is reduced. The material of the belt running guide 640 has a certain degree of rigidity, and various materials can be used if heat is not excessively conducted from the endless belt 630 and the running of the endless belt 630 is not hindered.

Further, in this embodiment, a plate-type heater is used as the heater 681. This heater 681 is housed at the bottom of the indentation 642 of the movable support table 641 of the pressing member 650 and heats the endless belt 630 through the elastic body 645.

Also, in this embodiment, walking of the endless belt 630 is limited with certainty by the walk guide unit 661 of the belt walk guide 660. The edge of the endless belt 630 is interposed between the extension 641*a* of the movable support table 641 and the collar 663 of the belt walk guide 660. As a result, buckling of the edge of the endless belt 630 is prevented with certainty.

Figure 23:
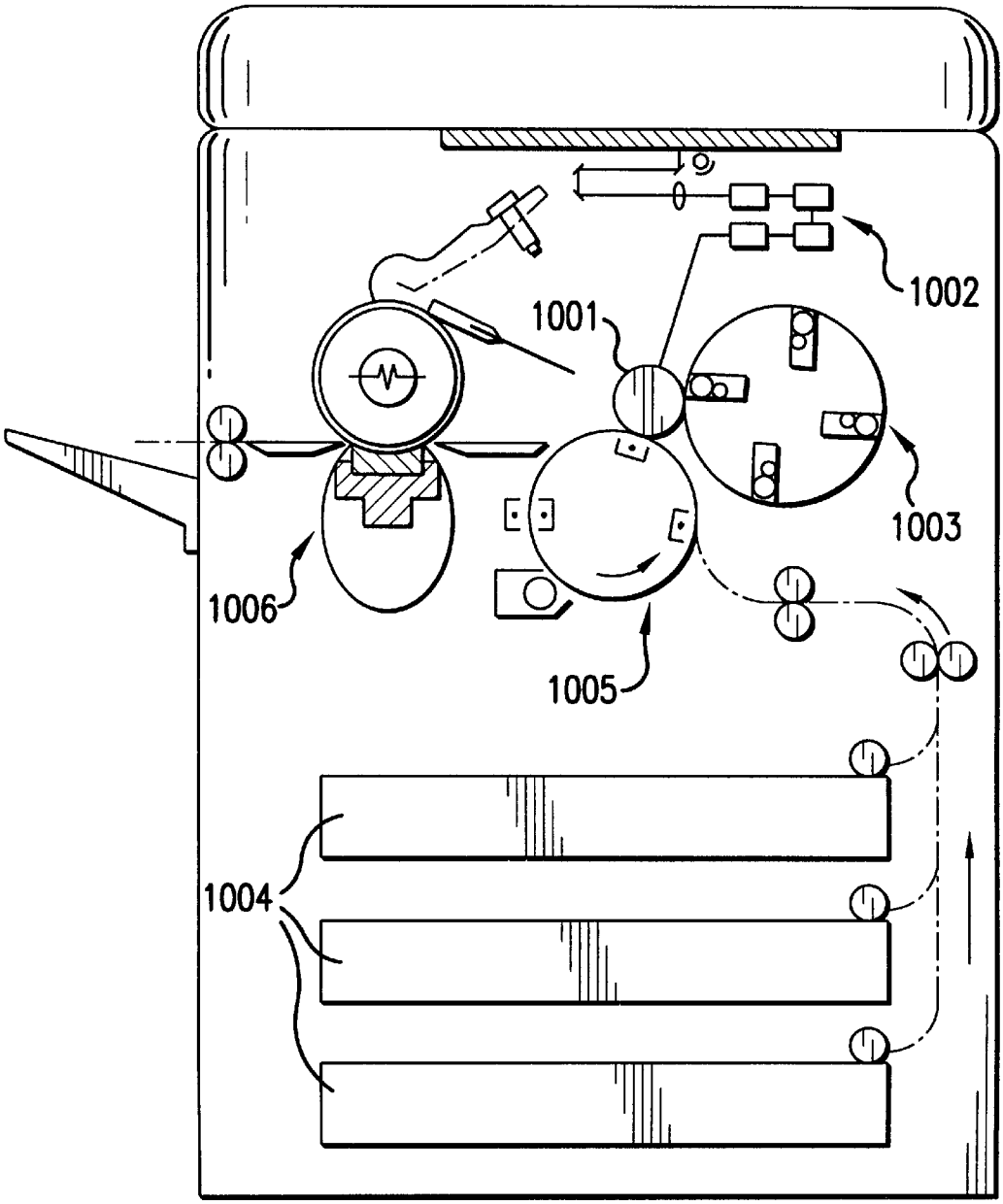
FIG. 23 is a schematic side view of a preferred image forming apparatus into which the fixation apparatus according to the invention has been incorporated.

FIG. 23 is a schematic side view of a preferred image forming apparatus incorporating the fixation apparatus of the invention. The image forming apparatus in FIG. 23 is an electronic photograph color image forming apparatus of using an imprint drum method. The image forming apparatus includes an image carrier 1001, such as a photosensitive drum; an image writing apparatus 1002, such as a laser scanning apparatus for writing the staticly latent image of each color onto this image carrier 1001; a multicolor developing apparatus 100,3 such as a rotating developing apparatus that makes the staticly latent image on the image carrier 1001 visible using each color of toner; an imprinting drum 1005 that holds a recording sheet (not shown) from a sheet supply cassette 1004 and which successively imprints each color toner image on the image carrier 1001 onto the recording sheet being held; a fixation apparatus that fixes the recording sheet onto which the various color toner images have been imprinted; and the fixation apparatus according to the embodiment of FIGS. 2–6 or the embodiment of FIG. 11, for example, may be used as the fixation apparatus 1006. In this kind of image forming apparatus, it is possible to increase image forming speed while lowering apparatus costs by using an inexpensive fixation apparatus conforming to instant starting.

As described above, with the invention belt walking is limited on the extension line of the contact nip region between the heating roll and the endless belt. Consequently the walking force that arises in the belt can be made to be collinear with the walk limiting force that acts on the belt edge. Hence, a moment that causes, for example, twisting does not act on the belt. Also, twisting, warping and buckling do not occur in the belt, and it is possible to achieve belt walking control in a simple manner.

Further, in the portion where the walk limiting force acts on the belt, the belt is interposed between the heating roll and the pressing member. Consequently it is possible to increase the buckling strength of the belt in the contact nip region. Through this arrangement, it is possible to use a belt made of resin such as polyimide without buckling occurring.

In addition, if the belt walk guide is caused to rotate along with the heating roll in the invention, rubbing with the belt edge does not occur. Thus, it is also possible to keep wearing of the belt edge small.

Further, if the belt walk guide is formed as one unit functioning as the heat-insulating bushing of the bearing and the heating roll in the invention, it is possible to set the size of the gap between the walk guide surface of the belt walk guide and the edge of the pressing member to 1.5 mm or less. Also, it is possible to increase the buckling force of the belt edge. Moreover, there is essentially no influence on higher costs caused by the portion that functions as the heat-insulating bushing.

Furthermore, in the invention if the endless belt is caused to have a curvature in the direction opposite the cylindrical shape of the belt in the contact nip region, the strength in the shaft direction of the belt becomes stronger, the cross-sectional second order moment becomes larger, and it is possible to increase the buckling strength.

In addition, in the invention if the pressure of the part that presses against the belt edge outside the contact nip region is made locally higher than at the contact nip region, it is possible to increase the buckling strength of the belt edge even if the interposition pressure of the contact nip region of the belt is set low to a certain degree while the pressure of the running region (fixation region) of the recording sheet in the contact nip region is normally set to the minimum required pressure for fixation, and it is possible to prevent buckling of the belt edge with even greater certainty.

Also, in the invention, if the belt walk guide is movably attached with respect to the shaft direction of the heating roll and the belt walk guide is pressed toward the belt side by the elastic energizing means, it is possible to reduce the varying component of the walking force caused by non-parallelness between the belt edge and the belt walk guide, and it is thus possible to reduce the maximum walking force.

Additionally, in the invention if the spacer member that covers the space into which the edge of the endless belt falls on the heating roll side is provided on the outside of the contact nip region of the heating roll, it is possible to prevent with certainty buckling of the edge of the endless belt toward the heating roll side.

The above effects can also be obtained similarly in a combination of a pressure roll and endless belt. Further, because the gap between the belt walk guide and the edge of the pressing member is covered, it is possible to avoid with certainty buckling of the edge of the endless belt in the direction of gravity. Consequently, it is possible to use with ease a belt made of resin such as polyimide without buckling occurring. In addition, in the invention, if the belt walk guide is caused to rotate along with the heating roll in the present invention, rubbing with the belt edge does not occur. Thus, it is also possible to keep wearing of the belt edge small. Furthermore, in the invention, if a contact surface area reduction part (curved surface) is formed between the movable belt walk guide and one of the edges of the pressing member, it is possible to reduce friction resistance between the two, and it is also possible to use this as a guide when integrating the heating roll side assembly and the pressing member side assembly.

In addition, if the belt walk guide is movably attached with respect to the shaft direction of the heating roll and the belt walk guide is pressed toward the belt side by the elastic energizing means, it is possible to position the belt walk guide at the edge of the pressing member at all times and to limit walking of the endless belt that is not in contact with the belt walk guide normally.

Hence, it is possible to reduce the varying component of the walking force caused by non-parallelness between the belt edge and the belt walk guide while keeping the wear on the edge of the endless belt caused by the belt walk guide to a minimum, and it is thus possible to reduce the maximum walking force.

Further, in the invention, if the spacer member that covers the space into which the edge of the endless belt falls on the heating roll side is provided on the outside of the contact nip region of the heating roll, it is possible to interpose the edge of the endless belt between the spacer member and the covering part between the edge of the pressing member and the belt walk guide, and hence it is possible to avoid with certainty buckling of the edge of the endless belt.

In addition, in the invention, the pressing member has an elastic body, and the edge of the elastic body has an extension that extends farther than the edge of the endless belt. Thus, it is possible to effectively prevent deformation and buckling of the elastic body edge, and to prevent buckling of the edge of the endless belt with greater certainty.

More specifically, the pressing member has an elastic body, and when a supporting member is installed so that the edge of this elastic body, which has an extension which extends beyond the edge of the endless belt, is supported from beneath, then the elastic body edge's deformation and the elastic body edge's buckling in the direction of gravity can be prevented effectively and the endless belt edge's buckling can be prevented with greater certainty.

Further, in the invention, if the pressing member is provided with an elastic body on an elastically energized movable body and the movable body position opposite the heating roll perimeter surface is limited by the movable body making contact with the surface orthogonal to the endless belt walk limiting surface of the belt walk guide, it is possible to prevent wear on the heating roll perimeter surface and on the endless belt by reducing the pressing force of the pressing member during wait times and empty run times of the fixation apparatus. It is also possible to control snaking of the endless belt by increasing the contact nip pressure when a recording sheet is passing through, and to achieve a good fixation action using a high nip pressure.

The above effects can also be obtained similarly in a combination of the pressure roll and endless belt.

In addition, if an image forming apparatus uses fixation apparatus of the invention, it is possible to accomplish image formation using an inexpensive fixation apparatus conforming to instant starting, and it is possible to provide an image forming apparatus conforming to instant starting.

While the invention has been described in conjunction with specific embodiments thereof, it is evident that many alternatives, modifications and variations may be apparent to those skilled in the art. Accordingly, the preferred embodiments of the invention as set forth herein are intended to be illustrative, not limiting. Various changes may be made without departing from the spirit and scope of the invention as defined in the following claims.

What is claimed is:

1. A fixation apparatus, of the type which causes an unfixed toner image to be fixed by heat and pressure onto a recording sheet, said fixation apparatus comprising:

a heating roll having a heat source and being capable of rotating;

an endless belt configured to be pressed onto said heating roll and move in conjunction with the heating roll;

a pressing member arranged on an inside of said endless belt which presses said endless belt against said heating roll, thereby forming a contact nip region between said endless belt and said heating roll; and a belt walk guide provided on at least one side of said endless belt, said belt walk guide positioned on an axis parallel to the central longitudinal axis of the heating roll and extending through the contact nip region between said heating roll and said endless belt, said guide restricting walking of edges of the endless belt;

wherein the belt walk guide is capable of moving along an axis defined by a shaft of the heating roll, said belt walk guide being elastically energized toward the endless belt by an elastic energizing element.

2. The fixation apparatus according to claim 1, wherein the belt walk guide is a ring-shaped member provided outside of the contact nip region formed by said heating roll and said endless belt.

3. The fixation apparatus according to claim 2, wherein the belt walk guide is formed integrally with a heat-insulating bushing of a bearing member.

4. The fixation apparatus according to claim 1, wherein the heating roll is rotationally driven, and the endless belt rotates in cooperation with the heating roll.

5. The fixation apparatus according to claim 1, wherein said belt is shaped into a cylindrical shape and said pressing member provides a curvature to said belt at the contact nip region between the heating roll and the endless belt in a direction which curves opposite to a curvature of the cylindrical shaped endless belt.

6. The fixation apparatus according to claim 1, wherein a pressing force at an edge of the pressing member is larger than a pressing force at a center of the contact nip region.

7. The fixation apparatus according to claim 1, wherein a spacer member is provided outside of the contact nip region of the heating roll, said spacer member covering a space to prevent the endless belt from moving toward the heating roll.

8. The fixation apparatus according to claim 1, wherein an edge of the pressing member extends past an edge of the endless belt and contacts with the belt walk guide.

9. The fixation apparatus according to claim 8, wherein the belt walk guide is a ring-shaped member provided outside of the contact nip region formed by said heating roll and said endless belt.

10. The fixation apparatus according to claim 9, wherein the belt walk guide further comprises a contact surface area reduction part formed between the belt walk guide that rotates in conjunction with the heating roll and an edge of the pressing member.

11. The fixation apparatus according to claim 8, wherein a spacer member is provided outside of the contact nip region of the heating roll, said spacer member covering a space to prevent the endless belt from moving toward the heating roll.

12. The fixation apparatus according to claim 11, wherein the belt walk guide is a ring-shaped member provided outside of the contact nip region formed by said heating roll and the endless belt, and the spacer member is formed integrally with the belt walk guide.

13. The fixation apparatus according to claim 8, wherein the pressing member comprises an elastic body provided on an elastically energized movable body, said elastically energized movable body comprising a surface facing a perimeter surface of the heating roll and a position of said elastically energized movable body being restricted by making contact with an edge of the movable body on a plane orthogonal to an endless belt walk limiting surface of the belt walk guide.

14. An image forming apparatus of the type wherein a toner image formed on an image carrier is imprinted onto a recording sheet and is fixed by heat and pressure by a fixation apparatus, wherein said image forming apparatus includes the fixation apparatus of claim 1.

15. A fixation apparatus, said fixation apparatus comprising:

a pressure roll being capable of rotating, an endless belt heated by a heat source and configured to rotate along with the pressure roll when pressed against the pressure roll, a pressing member arranged on an inside of said endless belt for causing said endless belt to be pressed against said pressure roll and forming a contact nip region between said endless belt and said pressure roll, wherein an unfixed toner image is heat and pressure fixed to a recording sheet when the recording sheet is passed through said contact nip region, and a belt walk guide that restricts walking of an edge of the endless belt on at least one side of the belt and positioned on an axis, parallel to the axis of the pressure roll and passing through the contact nip region between said pressure roll and said endless belt.

16. The fixation apparatus according to claim 15, wherein an edge of the pressing member extends past an edge of the endless belt and contacts with the belt walk guide.

17. An image forming apparatus of the type wherein a toner image formed on an image carrier is imprinted onto a recording sheet and is fixed by heat and pressure by a fixation apparatus, wherein said image forming apparatus includes the fixation apparatus of claim 15.

* * * * *